US008256758B2

(12) United States Patent
Kobayashi et al.

(10) Patent No.: US 8,256,758 B2
(45) Date of Patent: Sep. 4, 2012

(54) BOOKBINDING SYSTEM, BOOKBINDING METHOD, AND BOOKBINDING CONTROL PROGRAM

(75) Inventors: Kazuhiro Kobayashi, Kanagawa (JP); Nobuyoshi Suzuki, Tokyo (JP); Shinji Asami, Tokyo (JP); Naohiro Kikkawa, Kanagawa (JP); Tomohiro Furuhashi, Kanagawa (JP); Kiichiroh Gotoh, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 42 days.

(21) Appl. No.: 12/923,740

(22) Filed: Oct. 6, 2010

(65) Prior Publication Data

US 2011/0091259 A1 Apr. 21, 2011

(30) Foreign Application Priority Data

Oct. 16, 2009 (JP) ..... 2009-239356
Jun. 3, 2010 (JP) ..... 2010-128037

(51) Int. Cl.
*B31F 1/10* (2006.01)

(52) U.S. Cl. ..... 270/45; 270/32; 270/51; 270/58.07

(58) Field of Classification Search ..... 270/32, 270/45, 51, 58.07; 412/18, 22
See application file for complete search history.

(56) References Cited

U.S. PATENT DOCUMENTS 7,052,005 B2 * 5/2006 Yamakawa et al. ..... 270/37
7,285,084 B2 * 10/2007 Fujimoto et al. ..... 493/442
7,325,799 B2 * 2/2008 Watkiss ..... 270/39.08
7,562,866 B2 * 7/2009 Hayashi ..... 270/58.07
7,607,650 B2 * 10/2009 Oikawa et al. ..... 270/58.07
7,798,950 B2 9/2010 Kobayashi et al.
2006/0263174 A1 * 11/2006 Oikawa et al. ..... 412/33
2009/0137374 A1 5/2009 Kobayashi et al.
2009/0152789 A1 6/2009 Kikkawa et al.
2009/0200725 A1 8/2009 Tamura et al.
2009/0258774 A1 10/2009 Suzuki et al.
2011/0081186 A1 * 4/2011 Watanabe et al. ..... 399/408

FOREIGN PATENT DOCUMENTS

EP 1 780 036 5/2007
JP 2001-260564 9/2001
JP 2007-237562 9/2007

OTHER PUBLICATIONS

Extended Search Report for corresponding European patent application No. 10251806.5 dated Jan. 31, 2011.

* cited by examiner

*Primary Examiner* — Leslie A Nicholson, III
(74) *Attorney, Agent, or Firm* — Harness, Dickey & Pierce, P.L.C.

(57) ABSTRACT

A bookbinding system that includes: a center folding unit configured to perform center folding on an integrated sheet bundle; an additionally folding unit configured to additionally perform folding of a folded portion of the center-folded sheet bundle; a back surface forming unit configured to form a back surface on the sheet bundle by pressing a front end of the folded portion of the center-folded sheet bundle and both surfaces of the sheet bundle; and a control unit configured to change the content of additionally folding according to whether to perform the back surface forming or not.

18 Claims, 21 Drawing Sheets

BOOKBINDING SYSTEM, BOOKBINDING METHOD, AND BOOKBINDING CONTROL PROGRAM

CROSS-REFERENCE TO RELATED APPLICATIONS

The present application claims priority to and incorporates by reference the entire contents of Japanese Patent Application No. 2009-239356 filed in Japan on Oct. 16, 2009 and Japanese Patent. Application No. 2010-128037 filed in Japan on Jun. 3, 2010.

BACKGROUND OF THE INVENTION

1. Field of the Invention

The present invention relates to a bookbinding system including a back portion forming device that stitches and folds sheet-like recording medium, such as sheets, recording sheets, and transfer sheets (hereinafter, simply referred to "sheets"), on which images are formed, and makes the back portion of a stitched sheet bundle flat; a bookbinding method performed by the bookbinding system; and a bookbinding control program for performing the bookbinding method with a computer.

2. Description of the Related Art

There has been widely known a sheet processing device that is disposed at a rear portion of a main body of an image forming apparatus, and performs post-processing such as stitching on sheets to be output. However, the number of functions of the sheet processing device has been increased in recent years, so that not only side stitching but also saddle stitching are prevalent. Accordingly, a technique, which improves the folding quality of a booklet subjected to saddle stitch and folding, has been proposed as means for improving output quality.

For example, when a sheet bundle is saddle-stitched and center-folded (two-folded), the two-folded sheet bundle is swelled in a thickness direction near the folded portion thereof, which tends to deteriorate the appearance. Further, if the sheet bundle is swelled near the folded portion thereof, the back portion of the booklet becomes thick and an edge thereof becomes thin. Accordingly, when sheet bundles are stacked in the same direction, the stacked sheet bundles are apt to incline as the number of stacked sheet bundles increase. For this reason, if a plurality of sheet bundles is stacked, the inclination increases, so that the stacked sheet bundles collapse. Therefore, it is difficult to stack more than a certain number of sheet bundles. That is, there is a very high demand on the reduction of the folding height (swelling) after bookbinding in the saddle stitching that is widely used in the world as simple bookbinding. In general, several tens bound booklets are generally handled, that is, transported or delivered while being stacked. However, since the bound booklet, which is subjected to saddle stitching as described above, is swelled, only a small number of booklets may be merely stacked.

In contrast, if a booklet is formed by making the folded portion of a two-folded sheet bundle flat in the shape of a spine of a book, swelling of the booklet is pressed. Accordingly, it may be possible to stack a large number of booklets. That is, if only several booklets, which are swelled as described above, are stacked on the table, the stacked booklets collapse, which causes a problem in the handling of the booklets such as storing or transport. However, if a back portion corresponding to the folded portion is made flat, it may be possible to suppress swelling as much as possible and the above-mentioned problem is solved. Meanwhile, the back portion, which is mentioned here, means a back surface section (hereinafter, referred to as a back surface portion) that includes a back cover forming a back surface and front and back cover sections connected to the spine, and corresponds to a portion opposite to the edge of the booklet.

As user's countermeasures, there have been proposed a plurality of additionally folding mechanisms, such as a method of placing and leaving weights on booklets, a mechanism for performing folding several times, a mechanism for performing an additional folding by making a pressurizing roller run on a folded portion, and a mechanism for clamping a front end of a booklet and forming a plane at a folded portion with a back surface pressure roller.

Among these proposed mechanisms, for example, in the invention disclosed in Japanese Patent Application Laid-open No. 2001-260564, front and back surfaces of a booklet, which is formed of a sheet bundle of which a back portion is folded so as to be curved, are gripped and fixed with pressing means so as to be adjacent to a back portion, and a shaping roller presses a protruding back portion with pressure enough to make the curve of the back portion flat and runs on the back portion one time or several times in a longitudinal direction of the back portion, so that the back portion is made flat.

An advantage of making the curve of the back portion flat is obtained in this invention. However, since the back portion is locally and continuously pressed with a pressurizing roller and a plane is formed at the booklet back portion, wrinkles, breakage, or the like might be generated on the back surface or a stitched portion. Further, since the roller is moved along the folded portion, working time is inevitably lengthened.

Further, a sheet bundle forming device, which is disclosed in the invention disclosed in Japanese Patent Application Laid-open No. 2007-237562, includes clamping means, back portion pressing means, and compression means. The clamping means clamps a portion of a folded sheet bundle except for the periphery of the back portion of the folded sheet bundle in a thickness direction. The back portion pressing means presses the back portion in a direction toward an edge, opposite side of the back portion, by pressing a back portion pressing surface against the back portion of the clamped sheet bundle. The back portion pressing surface is formed at a back portion pressing member. The compression means shapes the periphery of the back portion of the sheet bundle by compressing the periphery of the back portion of the pressed sheet bundle in the thickness direction. In the invention of Japanese Patent Application Laid-open No. 2007-237562, portions of the front and back covers near the folded portion, which is pressed in the direction toward the edge with the back portion pressing means to be swelled, are shaped by compression with the compression means; and swelling is suppressed. That is, it may be possible to suppress the influence on the back portion, which is caused by the forming, as compared to the case where a member in the conventional technology is moved along the back portion while being pressed against the back portion with high pressure. Further, a recess is formed on an abutting surface of a sheet back surface abutting means, in order to remove the influence on the high protrusion from the sheet back surface, such as a loop stitcher.

In contrast to the invention disclosed in Japanese Patent Application Laid-open No. 2001-260564, in the invention disclosed in Japanese Patent Application Laid-open No. 2007-237562, it may be possible to form a plane at the booklet back portion without generating serious problems, such as wrinkles or breakage, on the back surface, the stitched portion, or the like. However, in terms of working time, a plurality of means, such as the clamping means, the back portion pressing means, and the compression means, needs to be sequentially operated after the booklet is abutted on the abutting plate and stopped. For this reason, an effect of reducing working time has been insufficient.

Further, in the saddle-stitching and center-folding of a booklet in the conventional technology, a pressurizing force of the folding rollers has been increased for the purpose of reducing the swelling of a booklet or an additionally folding roller has been disposed on the downstream of the folding rollers and an additional folding has been performed, so that the folded portion of the booklet has been pressurized and the swelling of the booklet is reduced. However, in this case, in forming a plane at the back portion of the booklet, the booklet needs to be swelled in the conveying passage. Accordingly, when the reducing the swelling of the folded portion of the booklet has been performed, the booklet is hardly swelled in the forming the plane at the back portion of the booklet, which is disadvantageous in back surface forming.

However, in outputting a booklet that does not need a process of forming the plane at a back portion of a booklet, a pressurizing force of the folding rollers is increased as the present conditions so as to reduce the swelling of the booklet. Alternatively, an additional folding roller and the like are disposed on the downstream of the folding rollers, so that the folded portion of the booklet is pressurized and the swelling of the booklet is reduced. Therefore, the optimum shape of the saddle-stitched and center-folded booklet is varied based on whether a plane is formed or not at the back portion of the booklet.

A problem to be solved by the present invention is: to form an optimum saddle-stitched and center-folded booklet (sheet bundle), respectively, regardless a plane forming process is performed or not at a back portion of a booklet; and to make it capable of forming a plane at a back portion of a booklet.

Meanwhile, in the embodiment to be described below, center folding means corresponds to a folding plate 215 and first folding rollers 230; additionally folding means corresponds to an additionally folding roller 520 or second folding rollers 233; sheet processing device corresponds to a sheet post-processing device 1 and a saddle-stitching device 2; back portion forming device corresponds to reference numeral 3; back surface forming means corresponds to upper and lower assistant clamping plates 320 and 321, upper and lower pressurization clamping plates 325 and 326, an abutting plate 330, and an abutting surface 330*a*; control means corresponds to CPUs 3-1 and 100-1; conveying means corresponds to upper and lower conveying belts 311 and 312; abutting means corresponds to an abutting plate 330; first clamping means corresponds to upper and lower assistant clamping plates 320 and 321; second clamping means corresponds to upper and lower pressurization clamping plates 325 and 326; sheet ejection means corresponds to a sheet ejection guide plate 335 and upper and lower sheet ejecting rollers 340 and 341; edge cutting means corresponds to an edge cutting device 4; saddle-stitching means corresponds to a saddle-stitching stapler S1; integration means corresponds to a saddle-stitching tray G; and a computer resource corresponds to a CPU, a ROM, and a RAM.

SUMMARY OF THE INVENTION

It is an object of the invention to at least partially solve the problems in the conventional technology.

According to an aspect of the present invention, a bookbinding system includes: a center folding unit configured to perform center folding on an integrated sheet bundle; an additionally folding unit configured to additionally perform folding of a folded portion of the center-folded sheet bundle; a back surface forming unit configured to form a back surface on the sheet bundle by pressing a front end of the folded portion of the center-folded sheet bundle and both surfaces of the sheet bundle; and a control unit configured to change the content of additionally folding according to whether to perform the back surface forming or not.

According to another aspect of the present invention, a bookbinding method for bookbinding a sheet bundle includes: performing center folding of an integrated sheet bundle; performing additionally folding of a folded portion of the center-folded sheet bundle; and performing back surface forming on the sheet bundle by pressing a front end of the folded portion of the center-folded sheet bundle and both surfaces of the sheet bundle, the content of the second step is changed according to whether to perform the back surface forming or not.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 9A shows an initial state, and FIG. 9B shows a state when a sheet bundle is conveyed;

FIG. 10A shows an initial state, and FIG. 9B shows a state when a sheet bundle is conveyed;

DETAILED DESCRIPTION OF THE PREFERRED EMBODIMENTS

Figure 1:
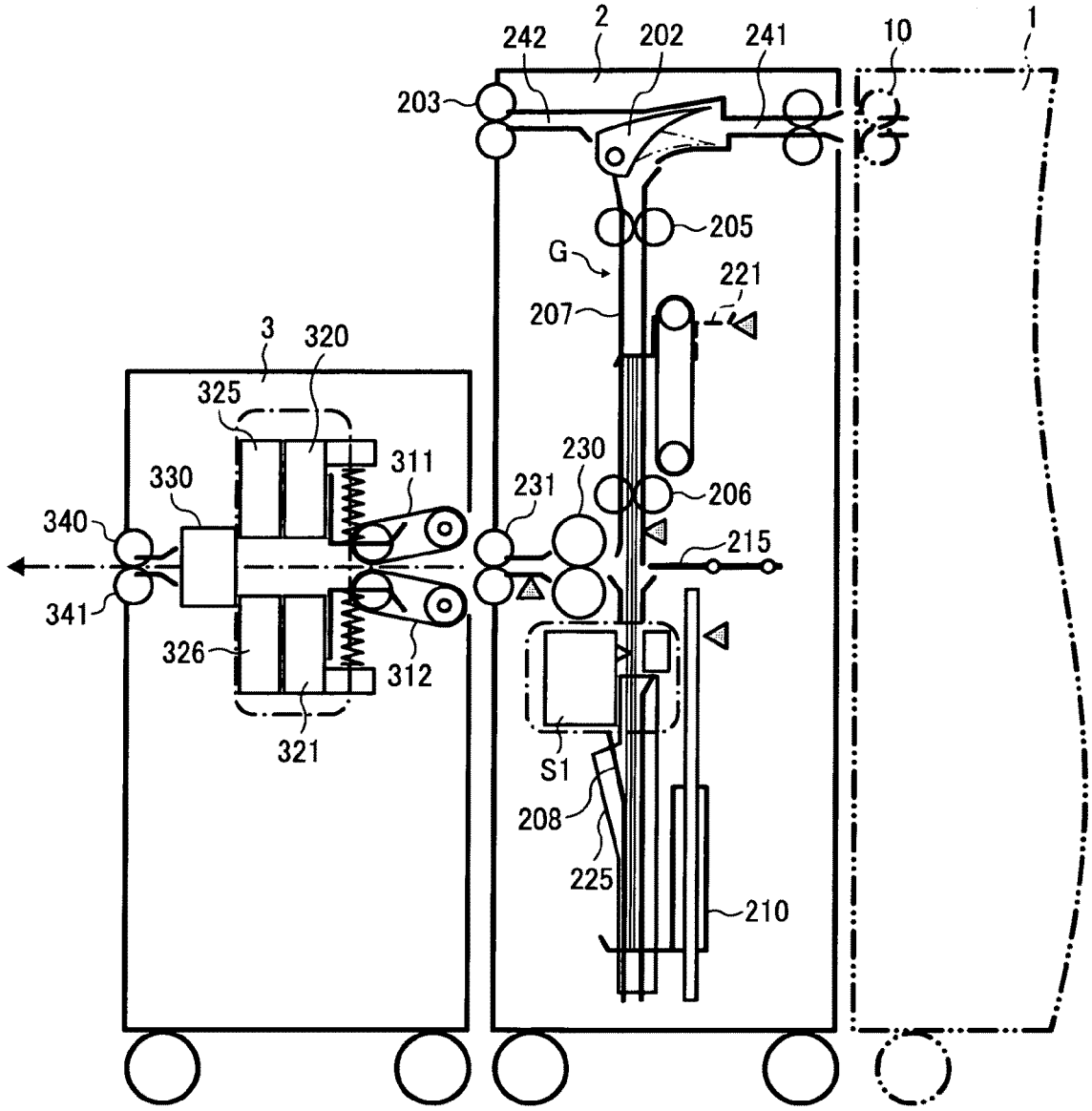
FIG. 1 is a view showing the system configuration of a sheet processing system that includes a sheet post-processing device and a back portion forming device of an embodiment of the invention and forms a back surface.

According to the present invention, conveying means, a conveying guide plate, assistant clamping means, pressurization clamping means, and abutting means are disposed in the above-described order from the upstream. A saddle-stitched booklet, which is conveyed by the conveying means, abuts on the abutting means positioned on the most downstream side, so that the booklet is swelled, stopped, and held in the conveying passage. When pressurizing is performed while a gap is reduced in the order of the conveying guide plate, the assistant clamping means, and the pressurization clamping means on the upstream side, swelling is sequentially concentrated on the downstream side. Then pressure clamping is performed by the pressurization clamping means while a front end portion of a booklet is finally pressed against the abutting means. Accordingly, when a plane is formed at a back portion of a booklet, the control of additionally folding is changed according to whether to perform back portion forming. Meanwhile, in this specification, among sheet bundles, a stitched and saddle-stitched sheet bundle, that is, a bound sheet bundle is particularly referred to as a booklet.

An embodiment of the invention will be described below with reference to drawings. Meanwhile, in the following description, equivalent components are denoted by the same reference numerals and the repeated description will be appropriately omitted.

FIG. 1 is a view showing the system configuration of a bookbinding system that includes a back portion forming device, a saddle-stitching device, a sheet post-processing device, and an image forming apparatus of this embodiment and performs processing to be performed between the image formation and back surface processing. In FIG. 1, a sheet post-processing device 1 is connected to the rear portion of the image forming apparatus and a saddle-stitching device 2 and a back portion forming device 3 as sheet processing devices are connected to the rear portion of the sheet post-processing device 1, so that one bookbinding system is formed. In general, a sheet bundle is carried into the saddle-stitching device 2 from sheet bundle ejecting rollers 10 of the sheet post-processing device 1, then the system performs saddle stitching and center folding on the sheet bundle, conveys the sheet bundle into the back portion forming device 3 from lower sheet ejecting rollers 231, and makes a folded portion of the sheet bundle flat with the back portion forming device 3, and ejects the sheet bundle to the outside of the system. The sheet post-processing device 1 includes a side stitching device, an inserter, or the like. A sheet on which an image has been formed is carried into the side stitching device from an image forming apparatus (not shown), and the side stitching device performs alignment, side stitching, and the like. The inserter inserts joined sheets, a front cover, a back cover, and the like.

An image forming apparatus forms a visible image on a sheet-like recording medium on the basis of input image data or the image data of a read image and corresponds to, for example, a copy machine, a printer, a facsimile, and a digital complex machine (MFP 100, see FIG. 18) that has at least two functions thereof. Meanwhile, the respective rollers operate in the form of pairs in the description of this embodiment, but are simply referred to as rollers. Meanwhile, only an additionally folding roller 520 to be described below is a single roller that does not make a pair.

Figure 2:
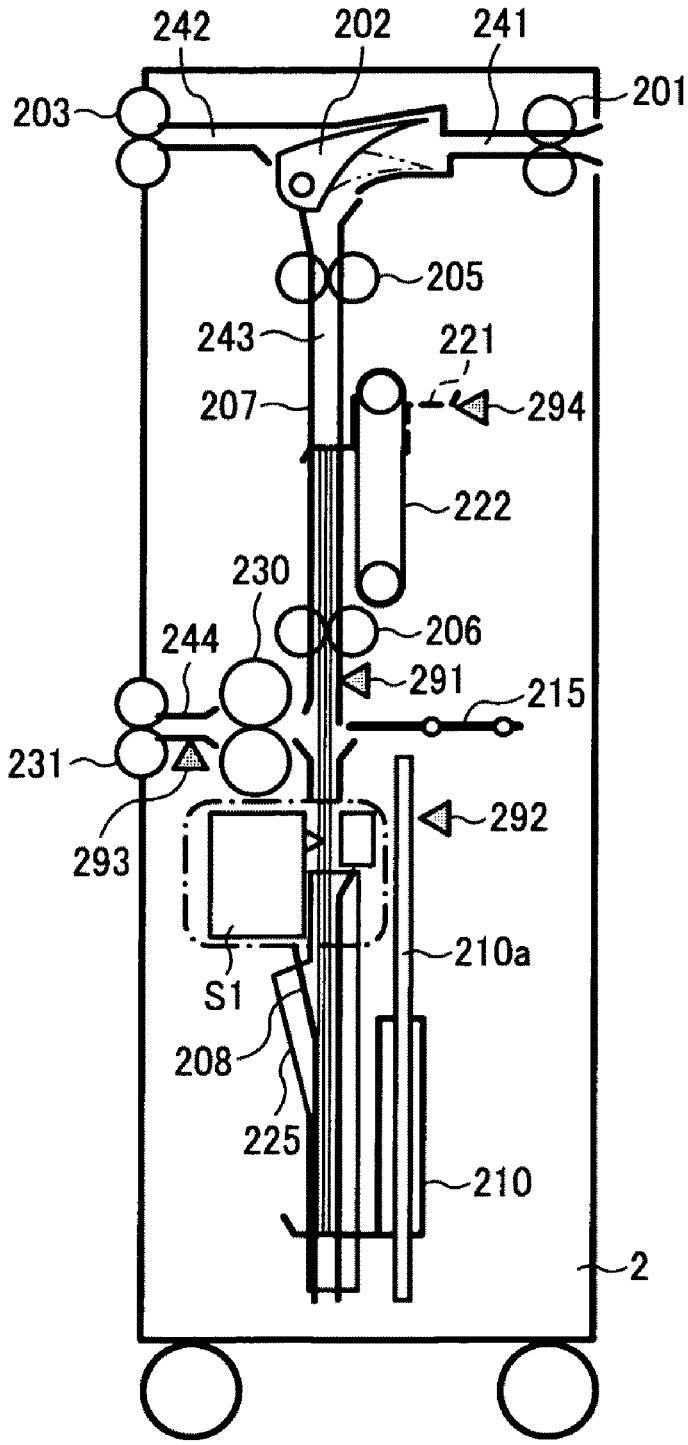
FIG. 2 is a front view showing the detail of the sheet post-processing device shown in FIG. 1.

FIG. 2 is a view showing the detailed structure of a saddle-stitching device shown in FIG. 1. In FIG. 2, the saddle-stitching device 2 includes an inlet conveying passage 241, a sheet-through conveying passage 242; and a center folding conveying passage 243. Inlet rollers 201 are provided at the most upstream portion of the inlet conveying passage 241 in a sheet conveying direction, and an aligned sheet bundle is carried into the saddle-stitching 2 device from the sheet bundle ejecting rollers 10 of the sheet post-processing device 1. Meanwhile, in the following description, an upstream side in the sheet conveying direction is simply referred to as an upstream side, and a downstream side in the sheet conveying direction is simply referred to as a downstream side.

A branching claw 202 is provided on the downstream side of the inlet rollers 201 of the inlet conveying passage 241. The branching claw 202 is installed in a horizontal direction in FIG. 2, and branches the conveying direction of the sheet bundle into the sheet-through conveying passage 242 or the center folding conveying passage 243. The sheet-through conveying passage 242 is a conveying passage that extends from the inlet conveying passage 241 in the horizontal direction and guides a sheet bundle to a sheet ejection tray or a processing device (not shown) provided on the rear side. The sheet bundle is ejected to the rear side by upper sheet ejecting rollers 203. The center folding conveying passage 243 is a conveying passage that extends downward from the branching claw 202 in a vertical direction and is used to perform saddle stitching and center folding on a sheet bundle.

The center folding conveying passage 243 includes an upper-bundle-conveying-guide-plate 207 that is provided above a folding plate 215 for performing center folding and guides a sheet bundle, and a lower-bundle-conveying-guide-plate 208 that is provided below the folding plate 215 and guides a sheet bundle. Upper bundle conveying rollers 205, a rear-end tapping claw 221, and lower bundle conveying rollers 206 are provided at the bundle conveying guide plate 207 in the above-described order from above. The rear-end tapping claw 221 is fixed to a rear-end tapping claw driving belt 222, which is driven by a drive motor (not shown), so as to be perpendicular to the rear-end tapping claw driving belt. The rear-end tapping claw 221 performs an operation for aligning the sheet bundle by tapping (pressing) the rear end of the sheet bundle toward a movable fence to be described below through the reciprocating rotation of the driving belt 222. Further, when a sheet bundle is carried and when a sheet bundle is lifted up for the center folding, the rear-end tapping claw 221 is retracted from the center folding conveying passage 243 of the upper-bundle-conveying-guide-plate 207 to a position shown by a broken line of FIG. 2. Reference numeral 294 denotes a rear-end tapping claw HP sensor for detecting a home position of the rear-end tapping claw 221. The rear-end tapping claw HP sensor detects the position, which is shown by a broken line of FIG. 2, of the rear-end tapping claw, which is retracted from the center folding conveying passage 243, as the home position. The rear-end tapping claw 221 is controlled on the basis of the home position.

A saddle-stitching stapler S1, saddle-stitching jogger fences 225, and a movable fence 210 are provided at the lower-bundle-conveying-guide-plate 208 in the above-described order from above. The lower-bundle-conveying-guide-plate 208 is a guide plate for receiving a sheet bundle that is conveyed through the upper-bundle-conveying-guide-plate 207. The pair of saddle-stitching jogger fences 225 is installed in a width direction of the lower-bundle-conveying-guide-plate 208, and the movable fence 210 where a front end of the sheet bundle is abutted (supported) is provided below the lower-bundle-conveying-guide-plate 208 so as to be vertically movable.

The saddle-stitching stapler S1 is a stapler that stitches the middle portion of a sheet bundle. The movable fence 210 vertically moves while supporting the front end portion of a sheet bundle, and positions the middle portion of the sheet bundle at a position facing the saddle-stitching stapler S1. Then, stapling, that is, saddle stitching is performed at the position. The movable fence 210 is supported by a movable fence driving mechanism 210*a*, and is movable to the lowest position from the position of a movable fence HP sensor 292 that is shown on the upper side. With respect to the movable range of the movable fence on which the front end of a sheet bundle is abutted, a processable stroke is secured between the maximum size and the minimum size that may be processed by the saddle-stitching device 2. Meanwhile, for example, a rack-and-pinion mechanism is used as the movable fence driving mechanism 210*a*.

The folding plate 215, a pair of folding rollers (first folding rollers) 230, a sheet ejection conveying, passage 244, and the lower sheet ejecting rollers 231 are provided between the upper and lower bundle-conveying-guide-plates 207 and 208, that is, at the substantially middle portion of the center folding conveying passage 243. The folding plate 215 is reciprocally movable in the horizontal direction in the drawings. Accordingly, a nip between the pair of folding rollers 230 is positioned in an operating direction when the folding plate performs a folding operation, and the sheet ejection conveying passage 244 is formed on the extension of the operating direction. The lower sheet ejecting rollers 231 are provided at the most downstream portion of the sheet ejection conveying passage 244, and eject a folded sheet bundle to the rear side.

A sheet bundle detecting sensor 291 is provided at the lower end of the upper-bundle-conveying-guide-plate 207, and detects the front end of a sheet bundle that is carried into the center folding conveying passage 243 and passes through a center folding position. Further, a folded portion passing sensor 293 is provided at the sheet ejection conveying passage 244. The folded portion passing sensor 293 detects front end of the center folded sheet bundle, and recognizes the passage of a sheet bundle.

Generally, in the saddle-stitching device 2 that has the structure shown in FIG. 2, a saddle-stitching operation and a center-folding operation are performed as shown in FIGS. 3 to 7. That is, when saddle-stitching/center-folding is selected from an operation panel (not shown) of the image forming apparatus, a sheet bundle for which the saddle-stitching/center-folding is selected is guided to the center folding conveying passage 243 by a counterclockwise biasing operation of the branching claw 202. Meanwhile, the branching claw 202 is driven by a solenoid. However, the branching claw 202 may be driven by a motor instead of a solenoid.

Figure 3:
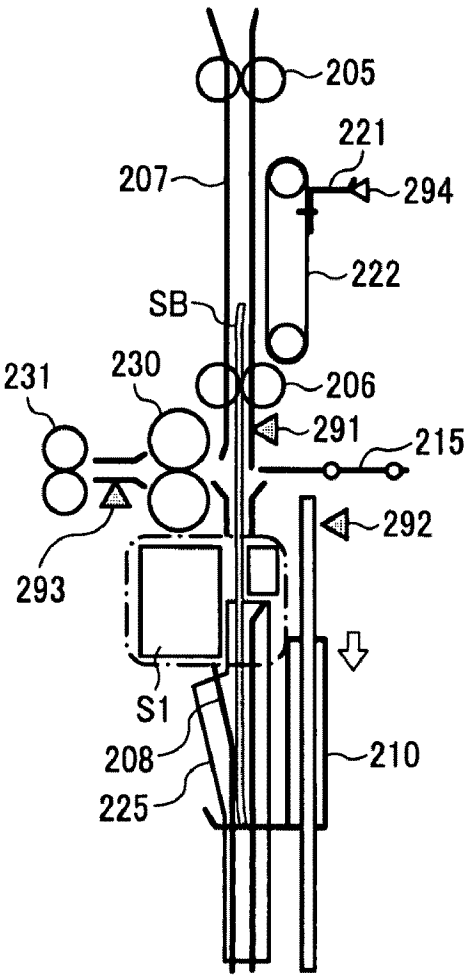
FIG. 3 is a view illustrating the operation of the sheet post-processing device, and shows a state when a sheet bundle is carried.

A sheet bundle SB, which is carried into the center folding conveying passage 243, is conveyed downward in the center folding conveying passage 243 by the inlet rollers 201 and the upper bundle conveying rollers 205, and the detecting sensor 291 confirms the passage of the sheet bundle passes. After that, as shown in FIG. 3, the sheet bundle is conveyed to a position, where the front end of the sheet bundle SB is abutted on the movable fence 210, by the lower bundle conveying rollers 206. At that time, the movable fence 210 waits at different stop positions in accordance with information, which is obtained from the image forming apparatus, in relation to the size of a sheet, herein, information on the size of the sheet bundle SB in the conveying direction. In this case, in FIG. 3, the lower bundle conveying rollers 206 clamp the sheet bundle SB at the nip therebetween and the rear-end tapping claw 221 waits at the home position.

Figure 4:
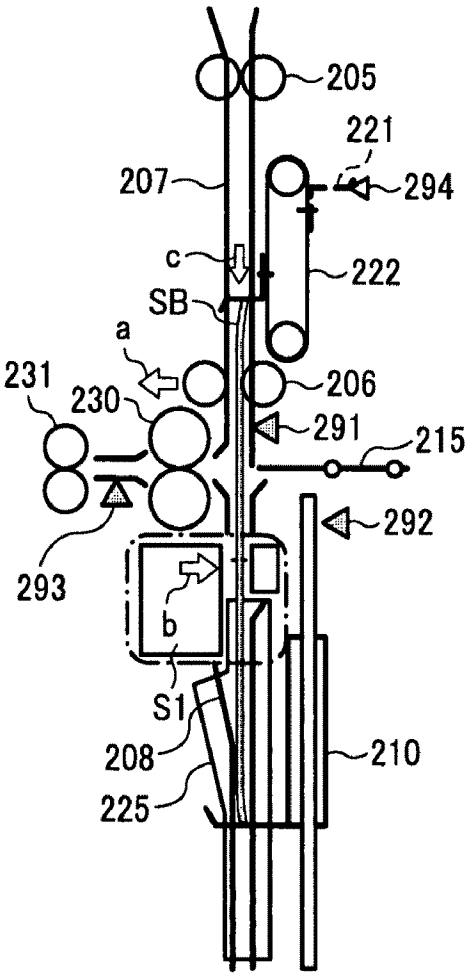
FIG. 4 is a view illustrating the operation of the sheet post-processing device, and shows a state when a sheet bundle is saddle-stitched.

In this state, when the clamping pressure of the lower bundle conveying rollers 206 is released (in a direction of an arrow "a") as shown in FIG. 4 and the sheet bundle is stacked while the front end of the sheet bundle is abutted on the movable fence 210 and the rear end of the sheet bundle is in a free state, the rear-end tapping claw 221 is driven and taps the rear end of the sheet bundle SB in order to perform the final alignment of the sheet bundle in the conveying direction (in a direction of an arrow "c").

After that, an operation for aligning the sheet bundle in the width direction (a direction orthogonal to the sheet conveying direction) is performed by the saddle-stitching jogger fences 225 and an operation for aligning the sheet bundle in the conveying direction is performed by the movable fence 210 and the rear-end tapping claw 221, so that an operation for aligning the sheet bundle SB in the width direction and the conveying direction is completed. In this case, after the pushing distances of the rear-end tapping claw 221 and the saddle-stitching jogger fences 225 are changed to optimum values according to information on the size of a sheet, information on the number of sheets of the sheet bundle, and information on the thickness of the sheet bundle, the rear-end tapping claw and the saddle-stitching jogger fences align the sheet bundle.

Further, since a space in the conveying passage is reduced if the bundle is thick, the bundle may not often be completely aligned by one alignment operation. Accordingly, the number of times of alignment is increased in this case. As a result, it may be possible to achieve a well-aligned state. Furthermore, as the number of sheets is increased, time taken to sequentially superimpose sheets on the upstream side is increased. Accordingly, time, which elapses until the next sheet bundle SB is received, is lengthened. As a result, since there is no time loss in the system even though the number of times of alignment is increased, it may be possible to efficiently achieve a well-aligned state. Accordingly, it may be possible to control the number of times of alignment according to the processing time on the upstream.

Meanwhile, the waiting position of the movable fence 210 is generally set to a position where the saddle-stitching position of the sheet bundle SB faces the stitching position of the saddle-stitching stapler S1. The reason for this is that it may be possible to perform stitching at the stacked position without moving the movable fence 210 to the saddle-stitching position of the sheet bundle SB if alignment is performed at this position. Accordingly, at the waiting position, a stitcher of the saddle-stitching stapler S1 is driven to the middle portion of the sheet bundle SB in a direction of an arrow "b" and stitching is performed between a clincher and the stitcher, so that the sheet bundle SB is saddle-stitched.

Meanwhile, the movable fence 210 is positioned by a pulse control that is output from the movable fence HP sensor 292. The rear-end tapping claw 221 is positioned by a pulse control that is output from the rear-end tapping claw HP sensor 294. The control of the positioning of the movable fence 210 and the rear-end tapping claw 221 is performed by a CPU 2-1 (see FIG. 18) of a control circuit of the saddle-stitching device 2.

Figure 5:
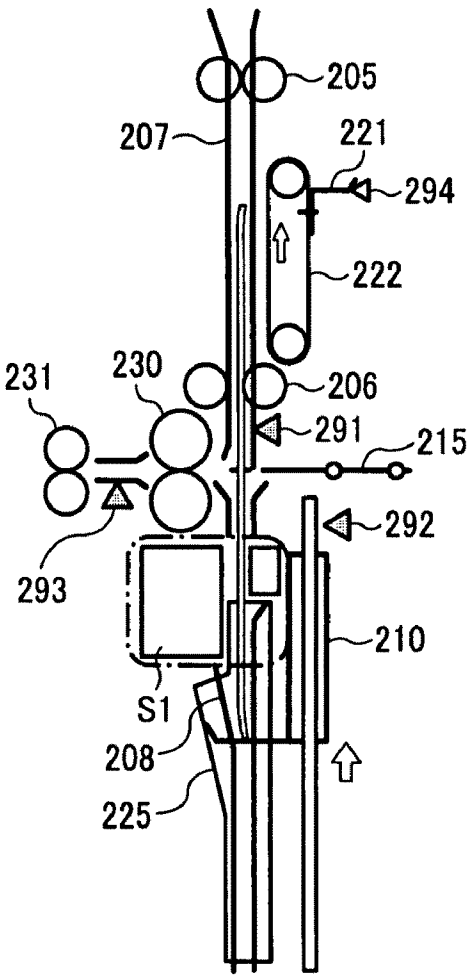
FIG. 5 is a view illustrating the operation of the sheet post-processing device, and shows a state when a sheet bundle is completely moved to a center folding position.

Along with the upward movement of the movable fence 210 while the pressurization of the lower bundle conveying rollers 206 is released as shown in FIG. 5, the saddle-stitching position of the sheet bundle SB, which is saddle-stitched in the FIG. 4, (the middle position of the sheet bundle SB in the conveying direction) is moved to a position facing the folding plate 215. This position is also controlled on the basis of the detection position of the movable fence HP sensor 292.

Figure 6:
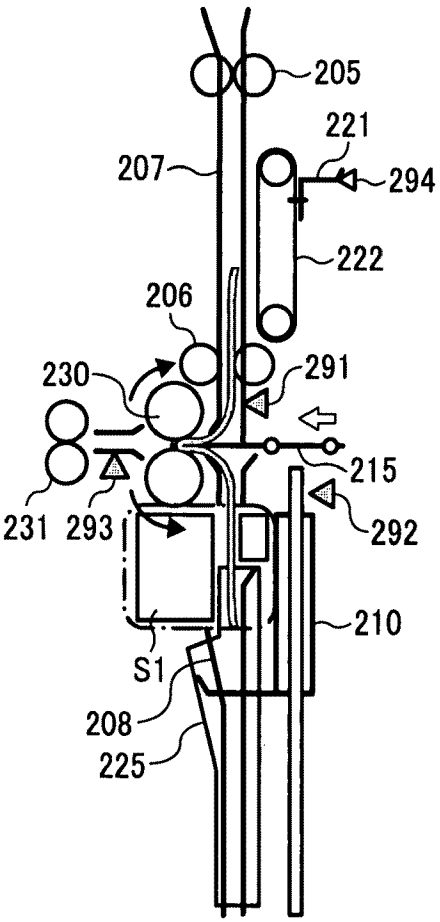
FIG. 6 is a view illustrating the operation of the sheet post-processing device, and shows a state when the center folding of a sheet bundle is performed.

When the sheet bundle SB reaches the position illustrated in FIG. 5, the folding plate 215 moves toward the nip between the pair of folding rollers 230 as shown in FIG. 6, is abutted on a portion of the sheet bundle SB near the stitched portion of the sheet bundle SB in a direction substantially perpendicular to the sheet bundle, and pushes the sheet bundle toward the nip. The sheet bundle SB is pushed by the folding plate 215 is guided to the nip between the pair of folding rollers 230, and is pushed into the nip between the pair of folding rollers 230 that is being previously rotated. The pair of folding rollers 230 pressurizes and conveys the sheet bundle SB that is pushed into the nip. Folding is performed at the middle of the sheet bundle SB by these pressing and conveying operations. FIG. 6 shows a state when the front end of the folded portion of the sheet bundle SB is clamped in the nip between the pair of folding rollers and pressurized.

Figure 7:
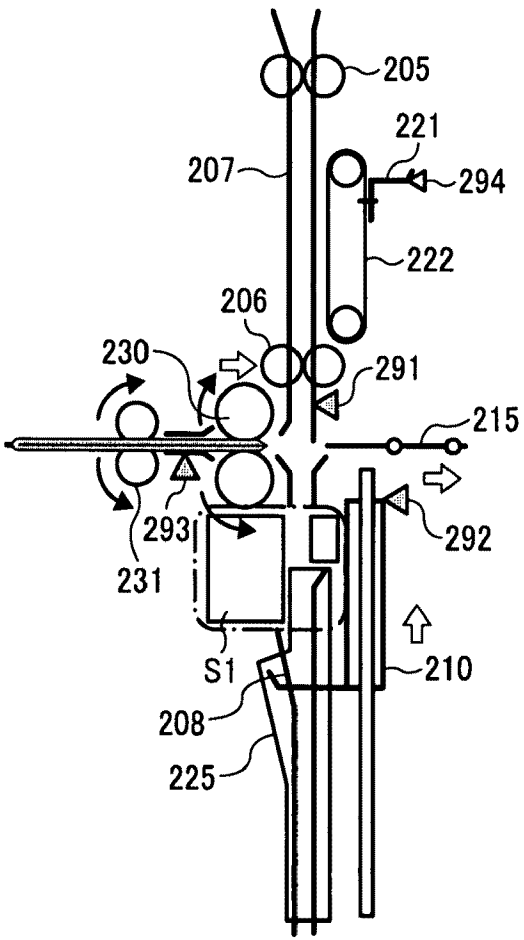
FIG. 7 is a view illustrating the operation of the sheet post-processing device, and shows a state when sheet ejection is performed after the completion of the center folding of a sheet bundle.

The sheet bundle SB of which the middle portion is two-folded in the state of FIG. 6 is conveyed by the pair of folding rollers 230 as shown in FIG. 7, and the sheet bundle SB is clamped by the lower sheet ejecting rollers 231, and is discharged to the rear side. In this case, when the rear end of the sheet bundle SB is detected by the folded portion passing sensor 293, the folding plate 215 and the movable fence 210 return to the respective home position and the lower bundle conveying rollers 206 return to a pressurized state so as to prepare for the carrying-in of the next sheet bundle SB. Further, if the size and the number of sheets of the next job are the same as those of the previous job, the movable fence 210 may be moved to the position of FIG. 3 and wait. Meanwhile, the above described control is also performed by the CPU 2-1 of the saddle-stitching device 2.

Figure 8:
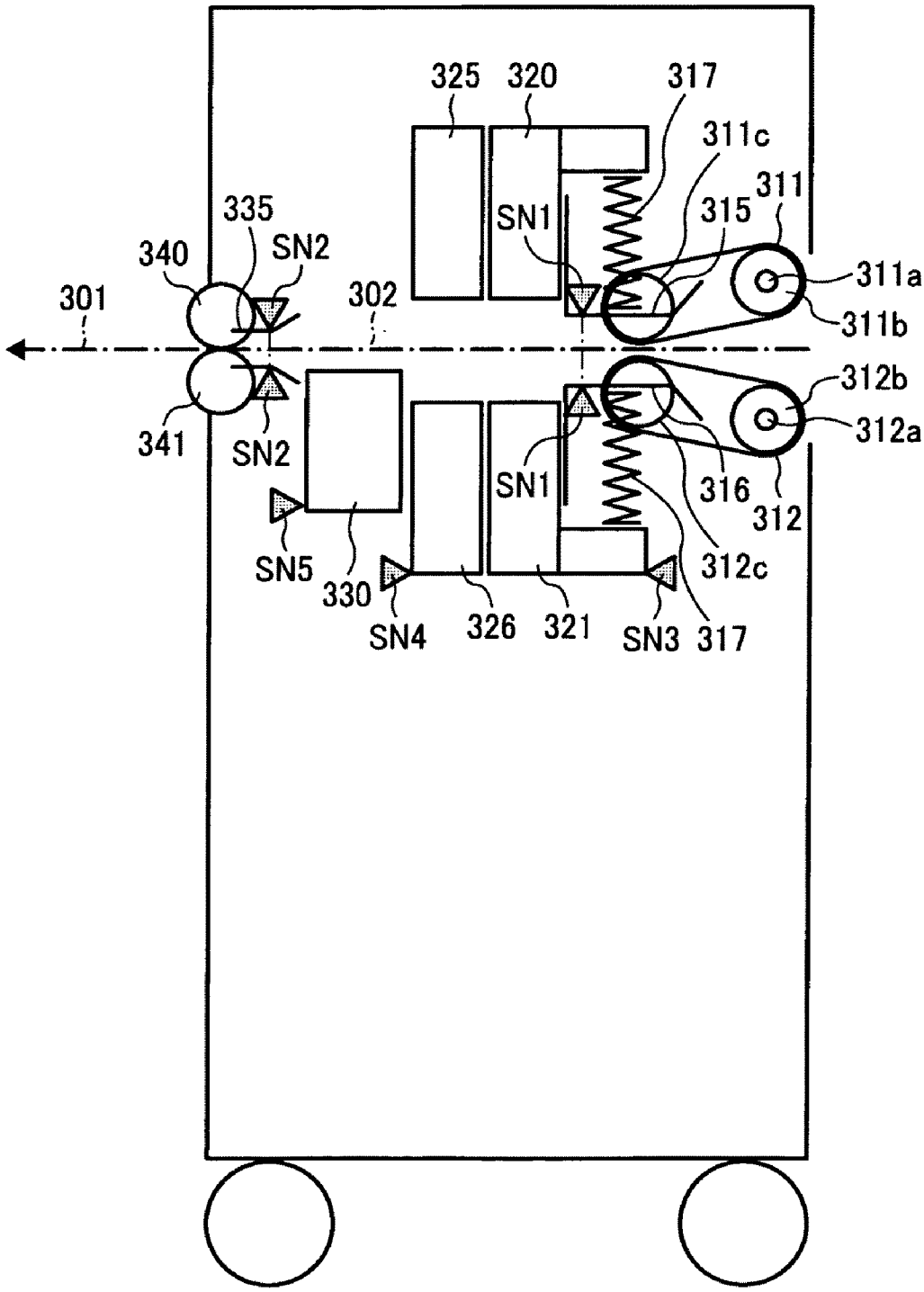
FIG. 8 is a front view showing the detail of the back portion forming device shown in FIG. 1.

FIG. 8 is a front view showing the detail of the back portion forming device shown in FIG. 1. The back portion forming device 3 includes a conveying unit, an assistant clamping unit, a pressurization clamping unit, an abutting unit, and a sheet ejecting unit which are disposed along a sheet bundle conveying passage 302 in the above described order from the upstream side.

The conveying unit includes upper and lower conveying belts 311 and 312, the assistant clamping unit includes upper and lower conveying guide plates 315 and 316 and upper and lower assistant clamping plates 320 and 321, the pressurization clamping unit includes upper and lower pressurization clamping plates 325 and 326, the abutting unit includes an abutting plate 330, and the sheet ejecting unit includes a sheet ejection guide plate 335 and upper and lower sheet ejecting rollers 340 and 341. Meanwhile, each of the units has a width that is equal to or larger than at least the width of the sheet bundle SB in a direction perpendicular to the plane of FIG. 8.

The upper and lower conveying belts 311 and 312 are stretched between driving pulleys 311*b* and 312*b* and driven pulleys 311*c* and 312*c*, respectively, and are driven by a drive motor (not shown). The driving pulleys 311*b* and 312*b* are pivotally supported by rotation fulcrums 311*a* and 312*a*, respectively. The driven pulleys 311*c* and 312*c* are positioned on the downstream side of the driving pulleys 311*b* and 312*b*, and face, each other with a conveyance center 301 interposed therebetween. The conveyance center 301 is set on the extension of a line that connects the folding plate 215, the nip between the pair of folding rollers 230, and the nip between the lower sheet ejecting rollers 231. The rotation'fulcrums 311*a* and 312*a* support the upper and lower conveying belts 311 and 312 so that a gap between the driven pulleys 311*c* and 312*c* may be varied in accordance with the thickness of the sheet bundle SB.

Figure 9A:
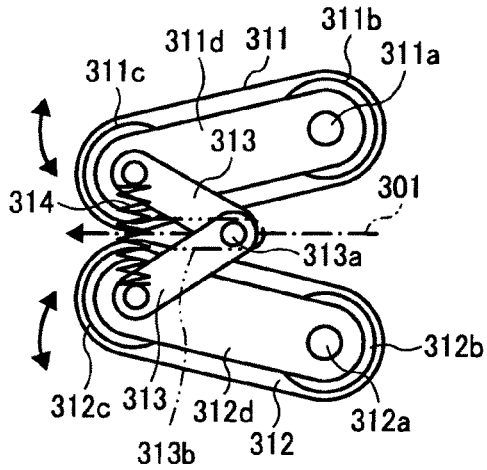
FIGS. 9A and 9B are views showing the detail of a conveying unit that conveys a sheet bundle in FIG. 1.
Figure 9B:
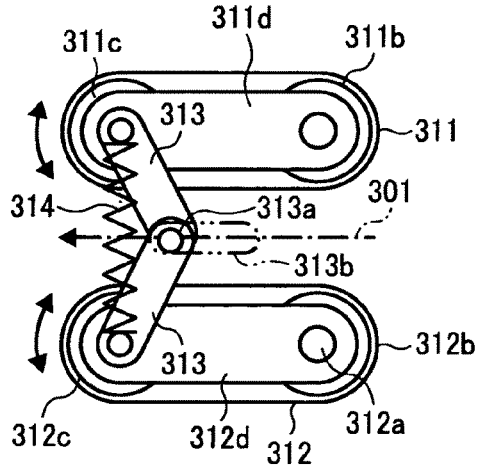

FIGS. 9A and 9B are views showing the detail of a conveying mechanism (conveying unit) that conveys a sheet bundle SB by the upper and lower conveying belts 311 and 312. FIG. 9A shows an initial state and FIG. 9B shows a state when a sheet bundle SB is being conveyed. As shown in FIGS. 9A and 9B, the driving pulley 311*b* and the driven pulley 311*c* are connected to each other by a support plate 311*d*, the driving pulley 312*b* and the driven pulley 312*c* are connected to each other by a support plate 312*d*, the upper conveying belt 311 is stretched between the driving pulley 311*b* and the driven pulley 311*c*, and the lower conveying belt 312 is stretched between the driving pulley 312*b* and the driven pulley 312*c*. Accordingly, the upper and lower conveying belts 311 and 312 receive driving forces from the driving pulleys 311*b* and 312*b*, respectively, and are rotated.

Links 313, which are formed of two members rotatably connected to each other by a connecting shaft 313*a*, are connected to rotating shafts of the driven pulleys 311*c* and 312*c*. An elastic force is applied to the links by a pressurizing spring 314 so that the links always approach each other. The connecting shaft 313*a* is movable along a long hole 313*b*, which is formed at a housing of the back portion forming device 3 so as to extend in the conveying direction. Accordingly, as the links 313 open or close the driven pulleys 311*c* and 312*c*, the connecting shaft 313*a* is moved along the long hole 313*b* as shown in FIG. 9B, a distance of the nip between the driven pulleys is changed so as to correspond the thickness of the sheet bundle SB, and the driven pulleys may apply predetermined clamping pressure to the sheet bundle.

Further, it may be possible to move the connecting shaft 313*a* along the long hole 313*b* by, for example, a rack-and-pinion mechanism, and to change the position of the connecting shaft 313*a* by controlling a drive motor that drives a pinion. Accordingly, if the sheet bundle SB is thick, it may be possible to set a conveying gap in which the sheet bundle SB is received (a distance of the nip between the driven pulleys 311*c* and 312*c*). Therefore, it may be possible to relieve pressure when portions of the upper and lower conveying belts 311 and 312 corresponding to the driven pulleys 311*c* and 312*c* run on a front end SB1 of the folded portion of the sheet bundle SB. Meanwhile, if the supply of power to the drive motor is stopped after the portions of the conveying belts run on the front end of the sheet bundle once, the driven pulleys 311*c* and 312*c* can clamp the sheet bundle SB by an elastic force of only the pressurizing spring 314 and apply a conveying force to the sheet bundle.

Figure 10A:
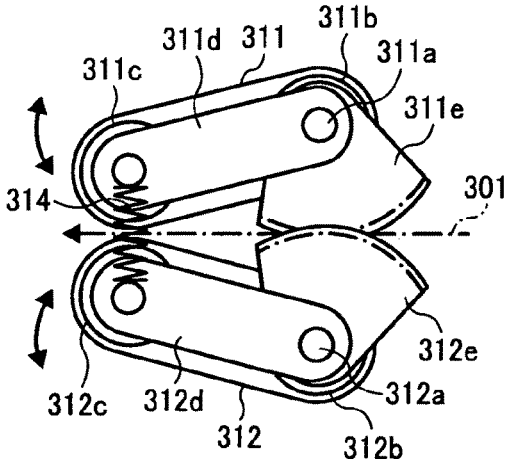
FIGS. 10A and 10B are views showing the detail of another example of a conveying unit that conveys a sheet bundle in FIG. 1.
Figure 10B:
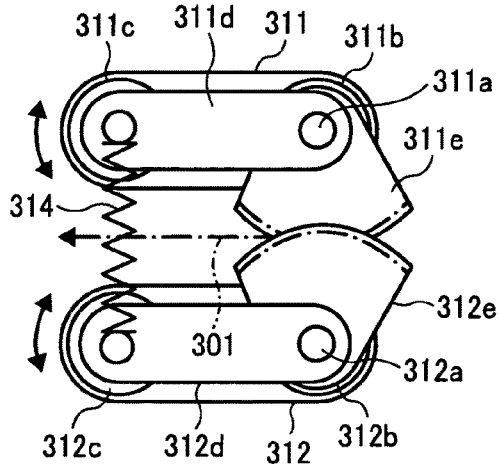

FIGS. 10A and 10B are examples where sector gears 311*e* and 312*e*, instead of the links 313, are connected to the rotation fulcrums 311*a* and 312*a* in FIGS. 9A and 9B and the driven pulleys are symmetrically separated from the conveyance center 301 by the engagement between the sector gears. Even in this case, FIG. 10A shows an initial state, and FIG. 10B shows a state when a sheet bundle SB is being conveyed. If one of the sector gears 311*e* and 312*e* can be driven by a drive motor including a reduction gear mechanism even in this case, it may be possible to set a conveying gap in which the sheet bundle SB is received like in the example shown in FIGS. 9A and 9B.

As shown in FIG. 8, upper and lower conveying guide plates 315 and 316 are symmetrically disposed near a conveying nip between the driven pulleys 311*c* and 312*c* for the upper and lower conveying belts 311 and 312 with the conveyance center 301 interposed therebetween. The upper and lower conveying guide plates 315 and 316 are formed in the shape of a flat surface from the vicinity of the conveying nip to the delivery portions of the upper and lower assistant clamping plates 320 and 321, respectively. The flat surface functions as a conveying surface. The upper and lower conveying guide plates 315 and 316 are mounted on the upper and lower assistant clamping plates 320 and 321, respectively, so as to be capable of being displaced in a vertical direction and pressurized (elastically pushed) toward the conveyance center 301 by pressurizing springs 317. Further, the upper and lower assistant clamping plates 320 and 321 are also guided and held by a housing (not shown) so as to be capable of being displaced in the vertical direction. Meanwhile, the upper and lower conveying guide plates 315 and 316 may be omitted and the surfaces of the upper and lower assistant clamping plates 320 and 321 facing the sheet bundle SB may be used instead of the upper and lower conveying guide plates.

The assistant clamping unit including the upper and lower assistant clamping plates 320 and 321 symmetrically approaches and be separated from the conveyance center 301, like the approaching/separating mechanism of the upper and lower conveying belts 311 and 312 of the above-mentioned conveying unit. The approaching/separating mechanism of the assistant clamping unit may be formed using the link mechanism described in the conveying unit, or the connecting mechanism or rack and sector gears. A reference position of the detection of the displaced position is set according to the detection output of an assistant clamping plate HP sensor SN3. Since a driving mechanism (not shown) and the upper and lower assistant clamping plates 320 and 321 are connected to each other by a spring such as the pressurizing spring 314 of the conveying unit, breakage caused by overload does not occur in the driving mechanism when the sheet bundle SB is clamped. Meanwhile, pressing-clamping surfaces of the upper and lower assistant clamping plates 320 and 321, which clamp the sheet bundle SB, are formed of flat surfaces parallel to the conveying direction, that is, the conveyance center 301.

The pressurization clamping unit includes upper and lower pressurization clamping plates 325 and 326. The upper and lower pressurization clamping plates 325 and 326 symmetrically approaches and be separated from the conveyance center 301, like the approaching/separating mechanism of the upper and lower conveying belts 311 and 312 of the above-mentioned conveying unit. The approaching/separating mechanism of the pressurization clamping unit may be formed using the link mechanism described in the conveying unit, or the connecting mechanism or rack and sector gears. A reference position of the detection of the upper and lower displaced positions of the upper and lower pressurization clamping plates 325 and 326 is set according to the detection output of a pressurization clamping plate HP sensor SN4. Since the operation and other structures of the upper and lower pressurization clamping plates 325 and 326 are the same as those of the above-mentioned assistant clamping plates 320 and 321, the description thereof will be omitted. Meanwhile, a drive motor is not necessary in the conveying unit. However, drive motors or other drive sources are necessary in the assistant clamping unit and the pressurization clamping unit. Accordingly, the sheet bundle SB may be moved to a clamping position and a retraction position by the driving forces generated by these drive motors or other drive sources. Further, like the upper and lower assistant clamping plates 320 and 321, pressing-clamping surfaces of the upper and lower pressurization clamping plates 325 and 326, which clamp the sheet bundle SB, are also formed of flat surfaces parallel to the conveying direction, that is, to the conveyance center 301.

The abutting unit is provided on the downstream side of the pressurization clamping unit. The abutting unit includes an abutting plate 330 and a moving mechanism (not shown) that moves the abutting plate 330 up and down. The abutting plate 330 is displaced so as to be capable of being moved forward and backward relative to the conveying passage 302, and a reference position of the detection of the displaced position of the abutting plate is set according to the detection output of an abutting plate HP sensor SN5. The top surface of the abutting plate 330 functions as a conveying guide for the sheet bundle SB at a position where the abutting plate is retracted from the conveying passage 302. For this reason, the top surface is formed of a flat surface parallel to the sheet conveying direction, that is, to the conveyance center 301. The moving mechanism may include rack-and-pinion mechanisms (not shown) that are provided, for example, on both sides of the abutting plate 330 (on the front and rear sides of the device), and a drive motor that drives a pinion. According to this structure, it may be possible to move the abutting plate 330 up and down by driving the drive motor, and to position the abutting plate at a predetermined position.

FIGS. 11 to 17 are views illustrating a back surface forming operation of the back portion forming device 3 that makes a folded portion of the sheet bundle SB flat and forms portions of front and back covers adjacent to the folded portion in a flat shape. An operation for forming the front end of the folded portion of the sheet bundle SB, that is, a back surface portion of the sheet bundle SB in a flat shape will be described below with reference to FIGS. 11 to 17.

Each of the units of the back portion forming device 3 performs an operation for getting ready to receive a sheet according to the detection signal of the sheet bundle SB that is output from the folded portion passing sensor 293 or an inlet sensor (not shown) of the back portion forming device 3. In the operation for getting ready to receive a sheet, the upper and lower conveying belts 311 and 312 begin to rotate; and the upper and lower assistant clamping plates 320 and 321 are once moved to the detection position of the assistant clamping plate HP sensor SN3, that is, a home position. Subsequently the upper and lower assistant clamping plates 320 and 321 are moved toward the conveyance center 301 so as to form a predetermined conveying gap (separation distance) therebetween, and are stopped at this position. The upper and lower pressurization clamping plates 325 and 326 are also moved to the detection position of the pressurization clamping plate HP sensor SN4 (home position). Subsequently the upper and lower pressurization clamping plates 325 and 326 are moved toward the conveyance center 301 so as to form a predetermined conveying gap (separation distance) therebetween, and are stopped at this position. Meanwhile, not only the upper and lower assistant clamping plates 320 and 321 but also the upper and lower pressurization clamping plates 325 and 326 are disposed symmetrically with respect to the conveyance center 301 and are symmetrically operated. Accordingly, when the home position of one of the assistant clamping plate and the pressurization clamping plate is detected, the other thereof is also in the same state. For this reason, the HP sensors SN3 and SN4 are disposed only on one side of the plates. The abutting plate 330 is moved to the detection position of the abutting plate HP sensor SN5 (home position). Subsequently the abutting plate 330 is moved toward the conveyance center 301 by a predetermined distance, and is stopped at a position where the conveying passage 302 is blocked. This state corresponds to a state where a sheet bundle SB is not carried-in in FIG. 11.

Figure 11:
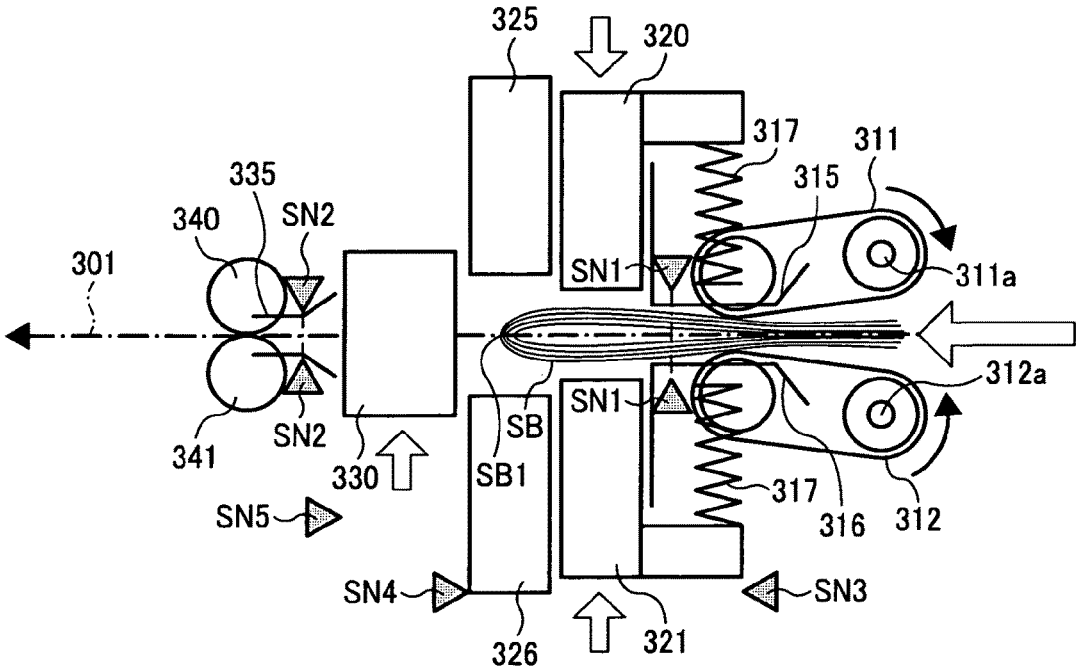
FIG. 11 is a view illustrating a back surface forming operation of the back portion forming device, and shows a state when a sheet bundle is carried.
Figure 12:
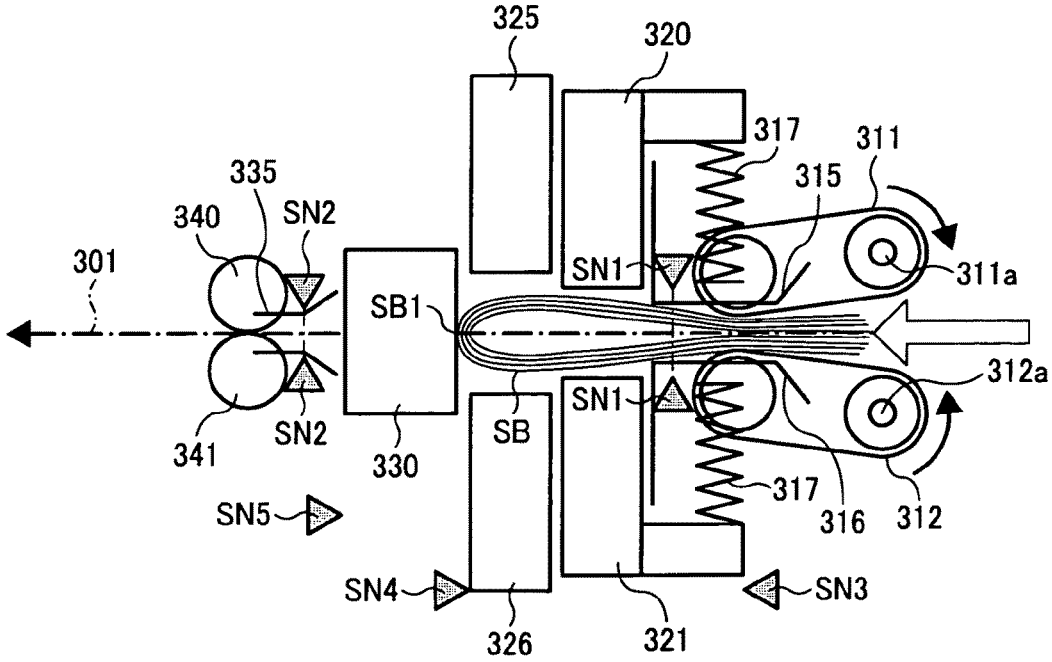
FIG. 12 is a view illustrating the back surface forming operation of the back portion forming device, and shows a state when a tip of a sheet bundle is abutted on an abutting plate.

In this state, the sheet bundle SB, which is ejected from the lower sheet ejecting rollers 231 of the saddle-stitching device 2 and is carried to the back portion forming device 3, is carried into the back portion forming device 3 as shown in FIG. 11 by the upper and lower conveying belts 311 and 312 that have been already rotating. The front end SB1 of the folded portion of the sheet bundle SB is, detected by a conveyance sensor SN1; and the front end SB1 of the folded portion is conveyed by a predetermined distance. The predetermined distance is obtained by adding a distance where the front end of the folded portion is abutted on the abutting plate 330 to a distance that is required to generate swelling SB2 required to fold the front end SB1 of the folded portion. After that, the sheet bundle is stopped as shown in FIG. 12. The predetermined distance is set according to information on the sheet bundle SB, such as thickness, size, stitching, the number of sheets, and a special sheet.

Figure 13:
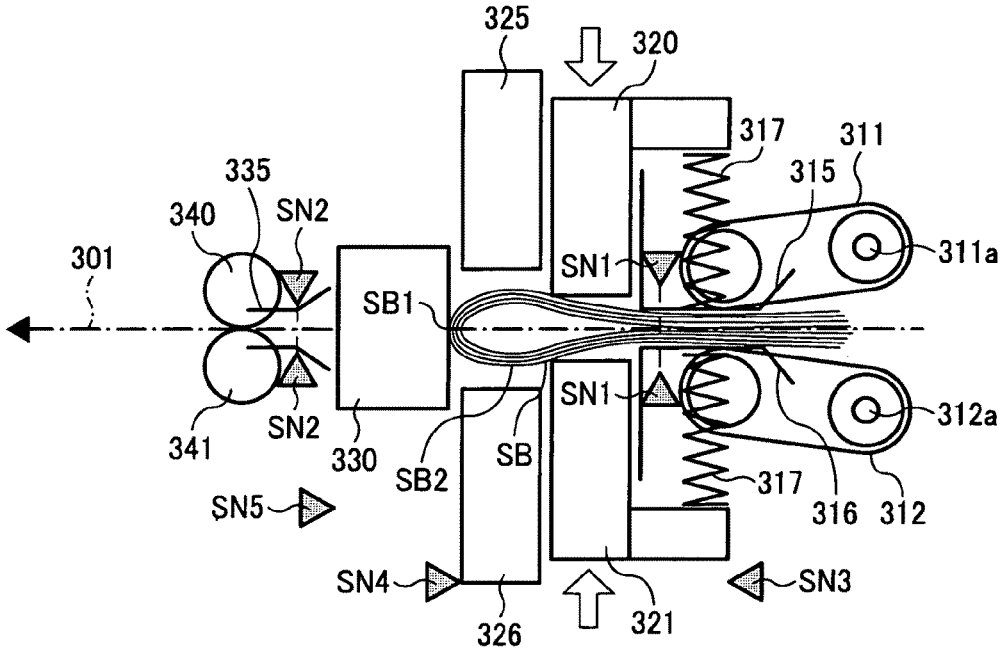
FIG. 13 is a view illustrating the back surface forming operation of the back portion forming device, and shows a state when a sheet bundle begins to be pressed and clamped by assistant clamping plates.
Figure 14:
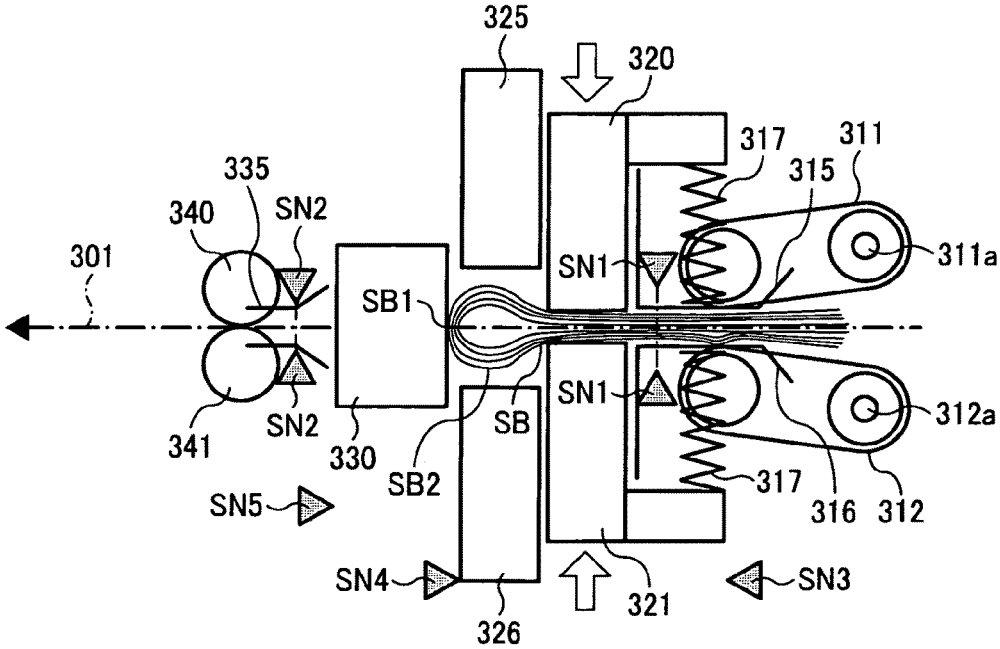
FIG. 14 is a view illustrating the back surface forming operation of the back portion forming device, and shows a state when a sheet bundle is completely pressed and clamped by the assistant clamping plates.

When the sheet bundle SB is stopped in the state illustrated in FIG. 12, the upper and lower assistant clamping plates 320 and 321 begin to move toward the conveyance center 301 as shown in FIG. 13. The upper and lower conveying guide plates 315 and 316 clamp the sheet bundle SB while pressurizing the sheet bundle with an elastic force of the pressurizing springs 317. From a time when a prescribed pressurizing force is applied to the sheet bundle by the upper and lower conveying guide plates 315 and 316, the upper and lower assistant clamping plates 320 and 321 further moves toward the conveyance center 301, and the sheet bundle SB is further clamped by the upper and lower assistant clamping plates 320 and 321. Then, when a pressurizing force generated by the upper and lower assistant clamping plates reaches a predetermined pressurizing force, the movement of the upper and lower assistant clamping plates 320 and 321 is stopped and the sheet bundle SB is held under the pressurizing force as shown in FIG. 14. Accordingly, the front end SB1 of the folded portion of the sheet bundle SB is abutted on the abutting plate 330, and swelling SB2 larger than the swelling SB2 shown in FIG. 13 is generated.

Figure 15:
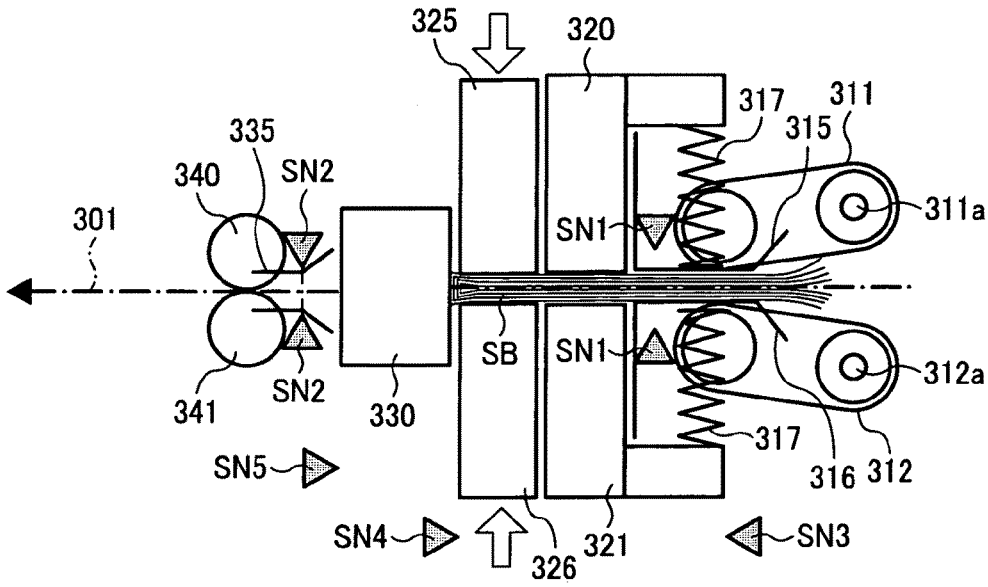
FIG. 15 is a view illustrating the back surface forming operation of the back portion forming device, and shows a state when a sheet bundle is completely pressed and clamped by pressurization clamping plates.

After that, when the upper and lower assistant clamping plates 320 and 321 pressurize and clamp the sheet bundle as shown in FIG. 14, the upper and lower pressurization clamping plates 325 and 326 begin moving toward the conveyance center 301 as shown in FIG. 15. As the upper and lower pressurization clamping plates 325 and 326 move, the swelling SB2 concentrated on the front end SB1 of the folded portion is gradually pressurized and deformed in the shape of a space that is formed by the upper and lower pressurization clamping plates 325 and 326 and the abutting plate 330. When the sheet bundle is completely pressurized, the front end SB1 of the folded portion of the sheet bundle SB forms a flat surface corresponding to the shape of the abutting plate 330 and a flat back surface (spine) is formed at the sheet bundle SB. Further, a front cover portion SB3 and a back cover portion SB4, which are formed near the folded portion, are formed of flat surfaces. Accordingly, it may be possible to provide a booklet where a square back surface portion is formed at the saddle-stitched/center-folded of the sheet bundle SB (see FIG. 17).

Figure 16:
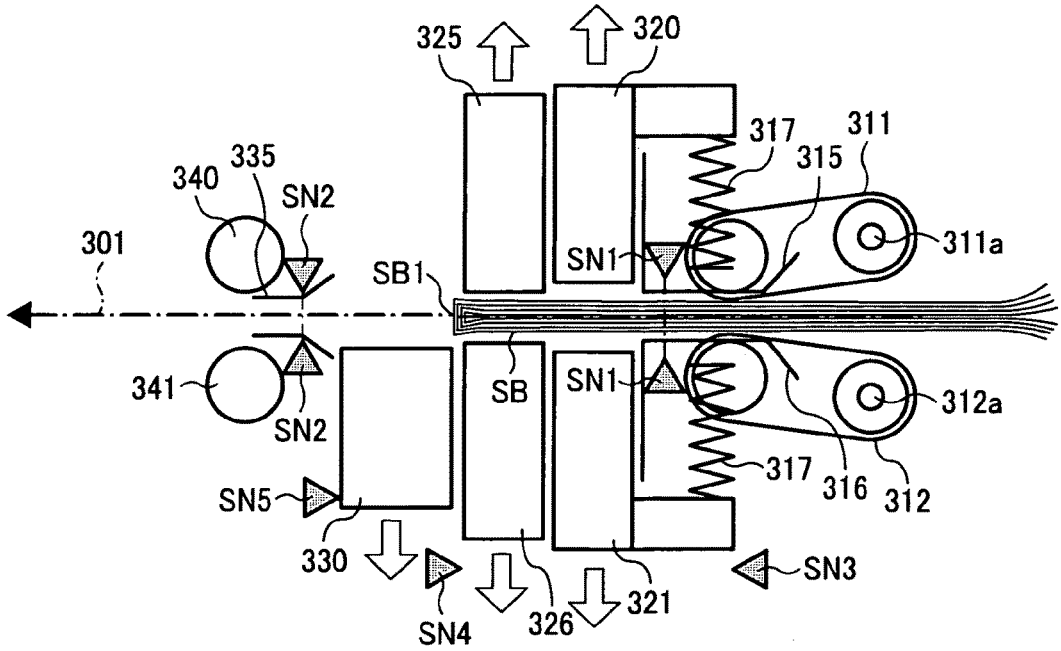
FIG. 16 is a view illustrating the back surface forming operation of the back portion forming device, and shows a state when an operation for forming a back surface of a sheet bundle is completed and pressing is released.

After that, as shown in FIG. 16, the upper and lower assistant clamping plates 320 and 321, and the upper and lower pressurization clamping plates 325 and 326 are separated from the sheet bundle SB and are stopped at predetermined positions, and the abutting plate 330 is also moved toward the home position and stopped at a position where the sheet bundle SB is guided by the upper surface of the abutting plate so as to be conveyed.

Figure 17:
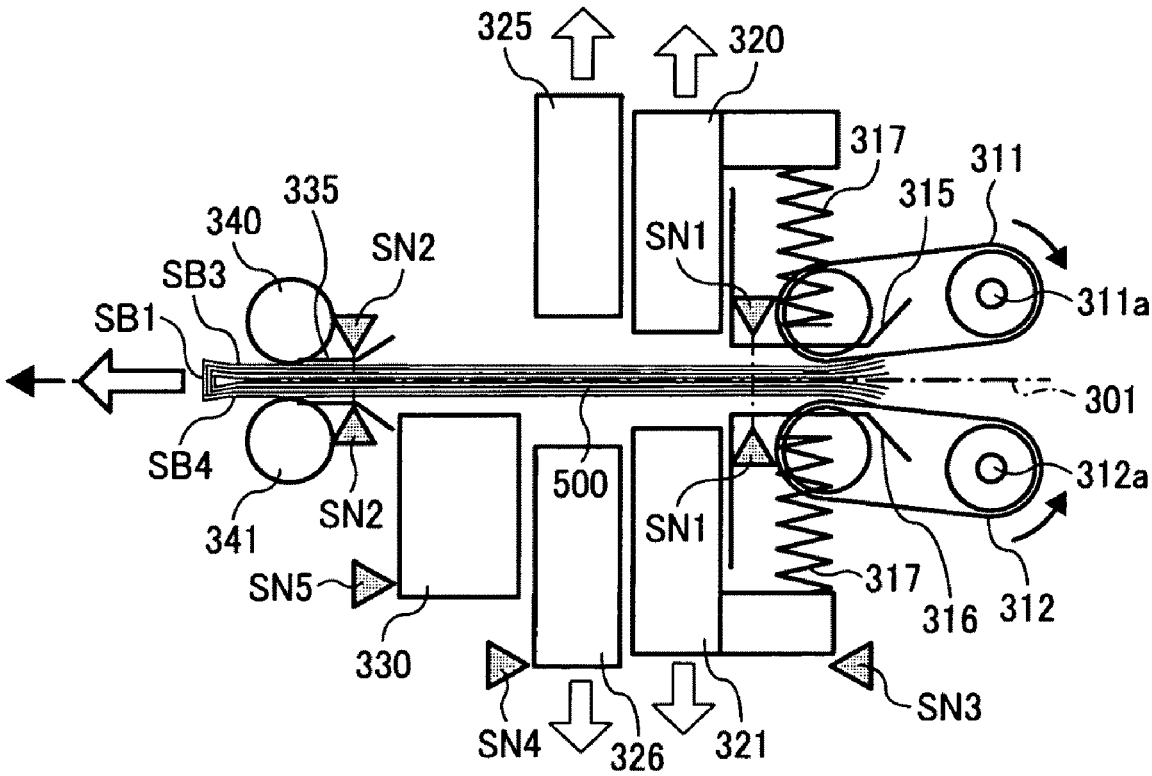
FIG. 17 is a view illustrating the back surface forming operation of the back portion forming device, and shows a state when an operation for forming aback surface of a sheet bundle is completed and the sheet bundle is carried.

After the upper and lower assistant clamping plates 320 and 321, the upper and lower pressurization clamping plates 325 and 326, and the abutting plate 330 are moved to waiting positions shown in FIG. 16, the upper and lower conveying belts 311 and 312 and the upper and lower sheet ejecting rollers 340 and 341 begin to rotate as shown in FIG. 17 and discharge the sheet bundle SB to the outside from the back portion forming device 3, so that a series of back surface processing operations are completed. The upper and lower conveying belts 311 and 312 and the upper and lower sheet ejecting rollers 340 and 341, which are rotating, are stopped after a predetermined time according to the detection information of a sheet ejection sensor SN2. In addition, other movable units are also moved to the home positions. If sheet bundles SB are successively conveyed from the saddle-stitching device 2 to the back portion forming device 3, the timing for stopping the rotation of the upper and lower conveying belts 311 and 312 and the upper and lower sheet ejecting rollers 340 and 341 is changed according to the conveying conditions of the following sheet bundle SB. Further, other movable units do not need to return to the home position every time, and the receiving position of the sheet bundle SB may also be changed according to information on the sheet bundle SB or conveying conditions.

Figure 18:
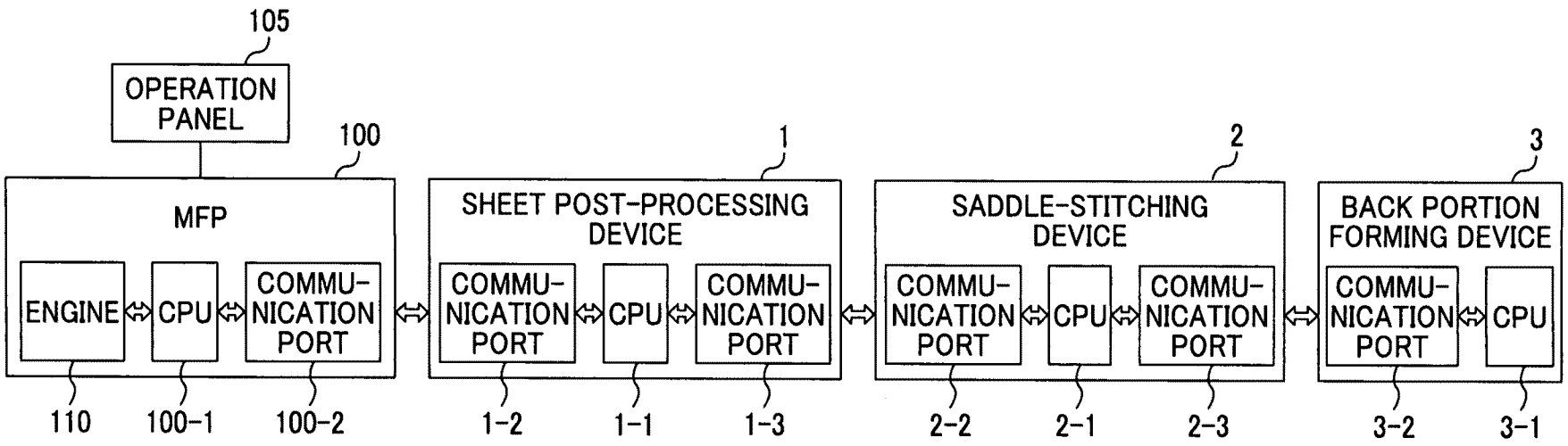
FIG. 18 is a block diagram showing the schematic on-line control configuration of a bookbinding system.

FIG. 18 is a block diagram showing the schematic on-line control configuration of a bookbinding system. That is, the sheet post-processing device 1 is connected to the MFP (image forming apparatus) 100, the saddle-stitching device 2 is connected to the sheet post-processing device 1, and the back portion forming device 3 is connected to the saddle-stitching device 2. The MFP 100 includes a CPU 100-1 and a communication port 100-2, the sheet post-processing device 1 includes a CPU 1-1 and communication ports 1-2 and 1-3, the saddle-stitching device 2 includes a CPU 2-1 and communication ports 2-2 and 2-3, and the back portion forming device 3 includes a CPU 3-1 and a communication port 3-2. The MFP 100 and the sheet post-processing device 1 may communicate with each other through the communication port 100-2 and the communication port 1-2, the sheet post-processing device 1 and the saddle-stitching device 2 may communicate with each other through the communication port 1-3 and the communication port 2-2, and the saddle-stitching device 2 and the (booklet) back portion forming device 3 may communicate with each other through the communication port 2-3 and the communication port 3-2. Further, the MFP 100 is provided with an operation panel 105, the CPU 100-1 of the MFP 100 controls the operation input and the display of the operation panel 105, and the operation panel 105 functions as an interface.

The CPU 100-1, CPU 1-1, CPU 2-1, and CPU 3-1, which are mounted on the MFP 100, the sheet post-processing device 1, the saddle-stitching device 2, and the back portion forming device 3 read program codes stored in the ROMs that are mounted on the MFP 100, the sheet post-processing device 1, the saddle-stitching device 2, and the back portion forming device 3, respectively. The CPU 100-1, CPU 1-1, CPU 2-1, and CPU 3-1 develop the program codes on RAMs; and execute programs written in the program codes by using the RAMS as work areas. Accordingly, the above-mentioned or the following various kinds of control or processing are performed. These respective devices are connected in series through the connected in series to each other in a linear shape (in an in-line form) through the communication port 100-2, the communication port 1-2, the communication port 1-3, the communication port 2-2, the communication port 2-3, and the communication port 3-2. In the case of on-line processing, control is performed under the control of the CPU 100-1 of the MFP 100 through the communication with the CPU 100-1 of the MFP 100. Meanwhile, in-line mentioned in this embodiment means that image formation, sheet processing, and saddle-stitching or booklet back surface processing are performed during the flow of the sheet bundle SB.

Figure 19:
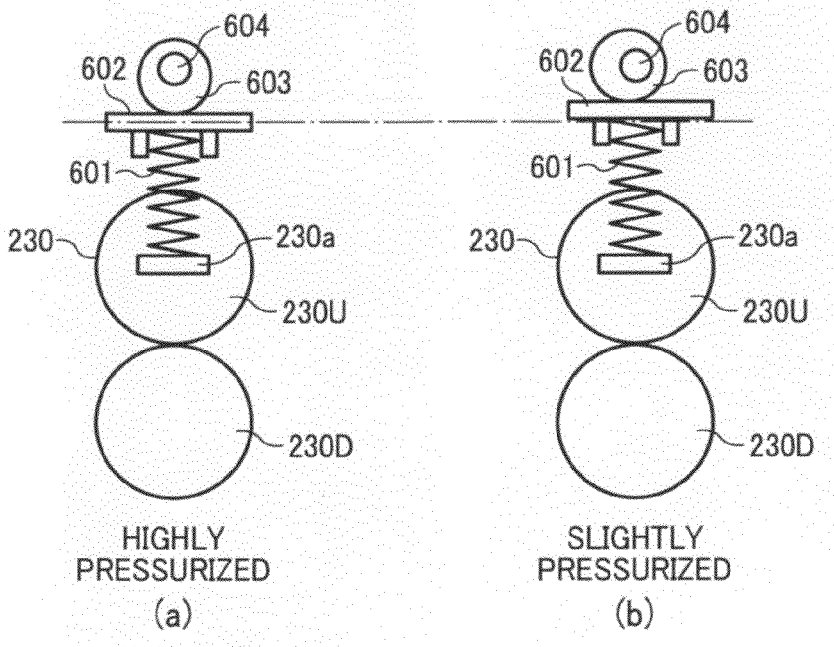
FIG. 19 is a view illustrating a variable pressurizing force mechanism for folding rollers.

FIG. 19 is a view illustrating a variable pressurizing force mechanism for the folding rollers 230. The (upper and lower) folding rollers 230 make a pair with a conveying path interposed therebetween. However, one roller of the folding rollers, that is, a folding roller 230U shown on the upper side in FIG. 19 is provided with a variable pressurizing force mechanism. The variable pressurizing force mechanism includes a compression spring 601 as elastic pushing means, a pressurizing member 602 that supports one end of the compression spring 601, an eccentric cam 603 that is abutted on a portion of the pressurizing member 602 opposite to the compression spring 601, a rotating shaft 604 that is provided at a position deviated from the center of the eccentric cam 603, and a pressurized member 230*a*. The pressurized member supports the upper folding roller 230U so that the upper folding roller can approach, and be separated from, and be rotated relative to the lower folding roller 230D.

According to this structure, it may be possible to adjust the length of the compressed compression spring 601 in accordance with the angle of the eccentric cam 603 and to set a pressurizing force between the folding rollers 230U and 230D. FIG. 19(*a*) shows a state when the compression spring is highly pressurized and FIG. 19(*b*) shows a state when the compression spring is slightly pressurized. When the compression spring is highly pressurized, the eccentric cam 603 is positioned, for example, at a position of FIG. 19(*a*) and the maximum pressurizing force is generated. When the compression spring is slightly pressurized, for example, the eccentric cam 603 is rotated by an angle of 90° from the position of FIG. 19(*a*) and the compression spring 601 is elongated, so that a pressurizing force may be reduced.

Meanwhile, the above-mentioned variable pressurizing force mechanism may be embodied in various forms by using a well-known mechanism.

Figure 20:
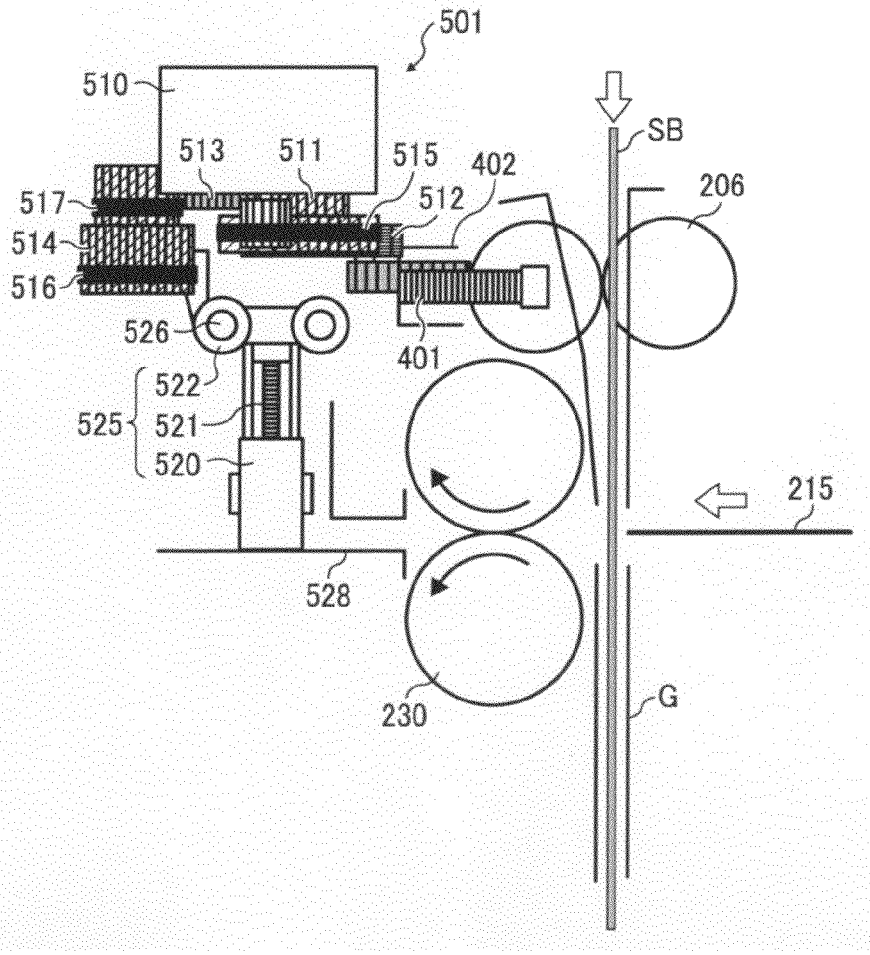
FIG. 20 is a view illustrating an additionally folding mechanism and the operation thereof, and shows a state before center folding is performed.
Figure 21:
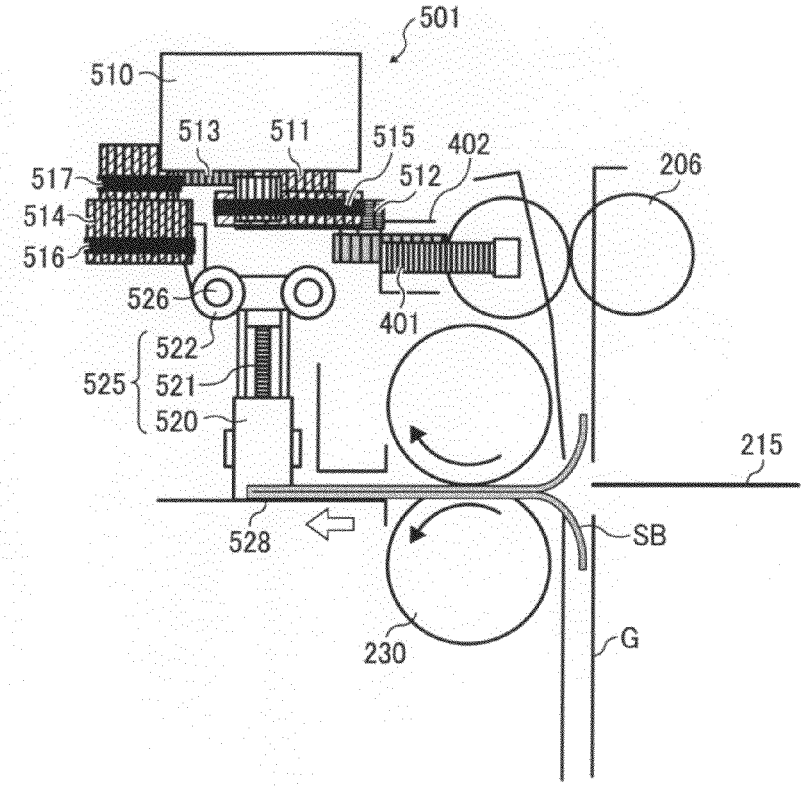
FIG. 21 is a view illustrating the additionally folding mechanism and the operation thereof, and shows a state when two-folding begins to be performed.
Figure 22:
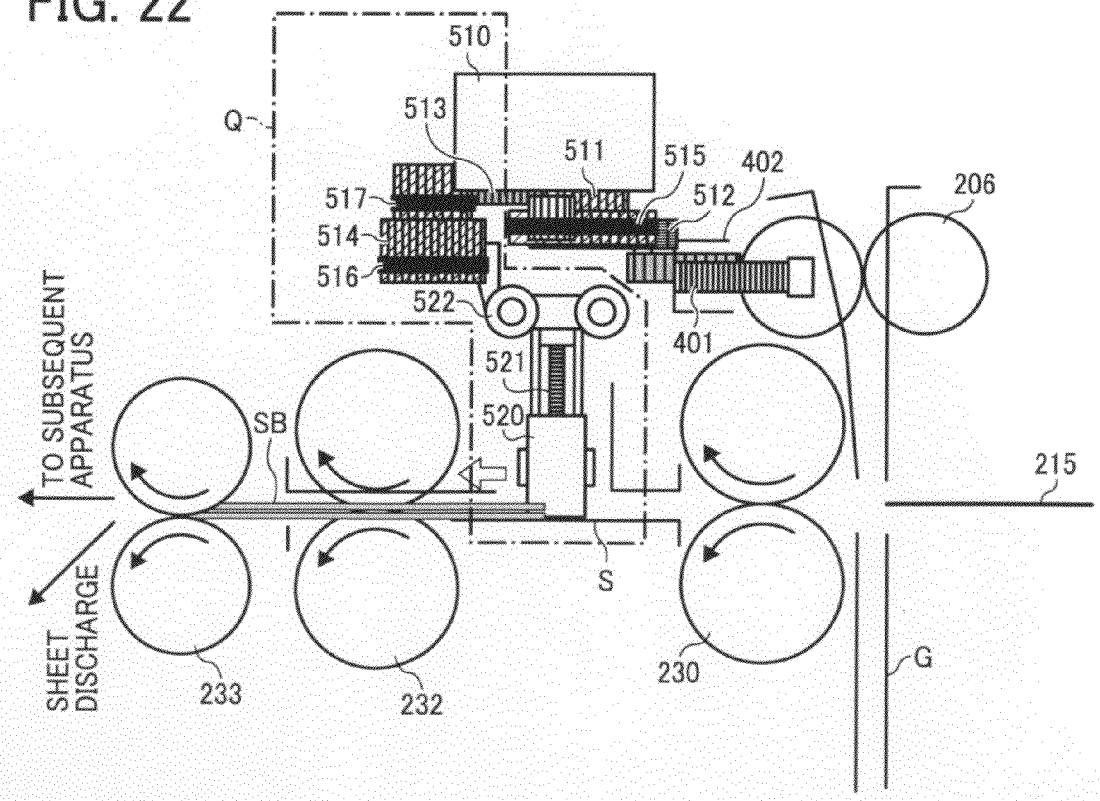
FIG. 22 is a view illustrating the additionally folding mechanism and the operation thereof, and shows an example that additionally folding is performed by the folding rollers.
Figure 23:
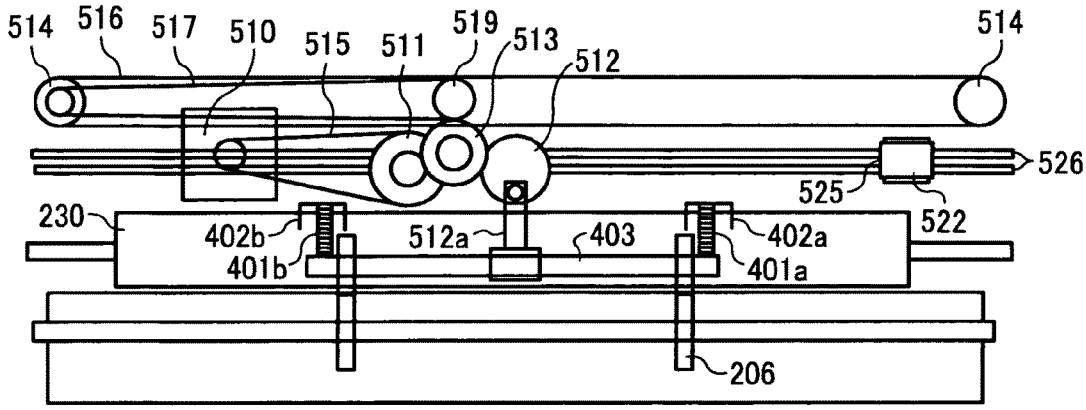
FIG. 23 is a view illustrating the additionally folding mechanism and the operation thereof, and shows a state when the mechanism shown in FIG. 20 is seen in plan view.
Figure 24A:
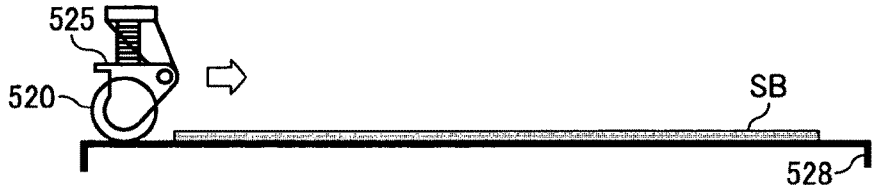
FIGS. 24A to 24C are views illustrating the additionally folding mechanism and the operation thereof, and show the moving state of an additionally folding roller.
Figure 24B:
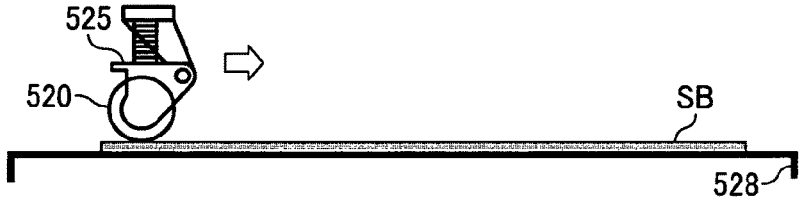
Figure 24C:
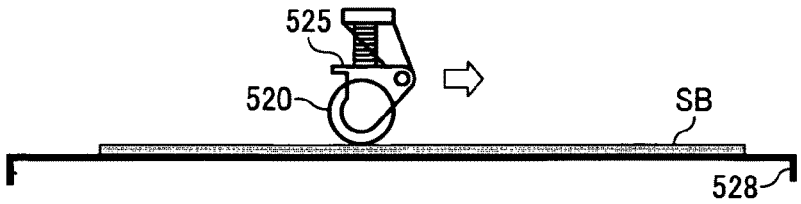
Figure 25:
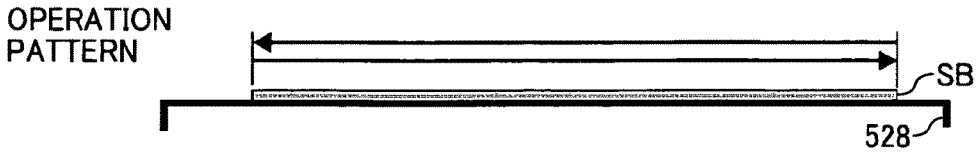
FIG. 25 is a view illustrating the additionally folding mechanism and the operation thereof, and shows the operation pattern of the additionally folding roller.

FIGS. 20 to 25 are views illustrating an additionally folding mechanism and the operation thereof. In this embodiment, an additionally folding roller 520 is provided between the first folding rollers 230 and the lower sheet ejecting rollers 231 as shown in FIG. 1. The additionally folding roller 520 is moved in a direction orthogonal to the sheet conveying direction, and performs additional folding. FIG. 20 shows a state before center folding is performed, FIG. 21 shows a state when two-folding begins to be performed, FIG. 22 shows another example of the additionally folding mechanism, FIG. 23 is a plan view the mechanism shown in FIG. 20, FIGS. 24A to 24C show the moving state of an additionally folding roller 520, and FIG. 25 shows the operation pattern of the additionally folding roller. Meanwhile, in FIG. 23, the additionally folding roller 520 is positioned at a maximum displacement position. A mechanism related with an additionally folding unit will be described below with reference to FIGS. 20 to 25.

An additionally folding unit 525 includes an additionally folding roller 520, a compression spring 521, and a slider 522. The slider 522 is supported between the front and rear plates of the device so as to be moved along a pair of guide rods 526 that is provided in a direction orthogonal to the sheet conveying direction. Further, the additionally folding roller 520 rolls while a predetermined pressurizing force is applied to the additionally folding roller by the compression spring 521. That is, a center folding unit includes two-folding unit that includes the first folding rollers 230 and the folding plate 215, and the additionally folding unit 525 that includes the additionally folding roller 520 for performing additionally folding, and second folding rollers 233

The additionally folding unit 525 performs additionally folding by the additionally folding roller 520 that scans the folded portion of the sheet bundle SB in a direction orthogonal to the sheet conveying direction. The additionally folding is performed by pressurizing the additionally folding roller 520 by an elastic member, herein, the compression spring 521; moving the slider 522 along the guide rods 526 on the folded portion of the sheet bundle SB while the slider is pressurized; and strengthening folding by the pressurizing force of the compression spring 521. Meanwhile, when a sheet bundle SB, is interposed between the additionally folding roller and a guide plate 528 that has a sheet receiving surface and is provided on the downstream side of the first folding rollers 230 in the sheet conveying direction, the additionally folding roller 520 may pressurize the sheet bundle SB.

Further, a driving mechanism 501, which drives the additionally folding roller 520 and performs the separation/approaching operation of lower bundle conveying rollers 206 and 205 making a pair, is provided above the additionally folding unit 525. The driving mechanism 501 includes a pressure-release motor 510, a pressure-release gear 512, an additionally folding roller driving gear 519, and an additionally folding roller driving pulley 514 (driving pulley and driven pulley). The pressure-release gear 512 receives a driving force from a drive transmission belt 515, which is stretched between a pulley fixed to a rotating shaft of the pressure-release motor 510 and a drive transmission gear 511, and is driven through a relay gear 513. Furthermore, the additionally folding roller driving gear 519 is meshed with the relay gear 513, and the pressure-release gear 512 and the additionally folding roller driving gear 519 are rotationally driven by the driving of the pressure-release motor 510.

The other end of a lever 512*a*, of which one end is swingably and pivotally supported by a longitudinal middle portion of a driven shaft 403 provided on the side of the lower bundle conveying roller 206 corresponding to the first folding roller 230, is rotatably and pivotally supported near the outer peripheral portion of the pressure-release gear 512 in FIG. 20 at the lower portion of the pressure-release gear. Accordingly, as the pressure-release gear 512 is rotated, the driven shaft 403 linearly reciprocates relative to the lower bundle conveying roller 206 that makes a pair with the driven shaft 403, and thereby it becomes possible to approach and be separated from the sheet bundle SB that is carried in a saddle-stitching tray G. In order to apply a conveying force to this approaching/separation operation and the sheet bundle SB clamped in the nip between the lower bundle conveying rollers 206, one end of elastic means, herein, compression springs 401 is fixed to a fixed plate 402 and the other end thereof is elastically pushed toward the side where the lower bundle conveying roller 206 approach. Meanwhile, since the compression springs 401 elastically push both end portions of the driven shaft 403 in FIG. 23, the compression springs are denoted by reference numerals 401*a* and 401*b* and the fixed plates are denoted by reference numerals 402*a* and 402*b*.

On the other hand, an additionally folding roller moving belt 517 is stretched between the additionally folding roller driving gear 519 and the additionally folding roller driving pulley 514, and transmits the driving force of the pressure-release motor 510 to the additionally folding roller driving pulley 514. An additionally folding roller moving belt 516 is further provided and stretched between the additionally folding roller driving pulley 514 and an additionally folding roller driven pulley, and the slider 522 for supporting the additionally folding roller 520 is mounted on the additionally folding roller moving belt 516. For this reason, the additionally folding roller moving belt 516 is stretched parallel to the guide rods 526, and the relative positions of the additionally folding roller driving pulley 514 and the additionally folding roller driven pulley are set so that the additionally folding roller moving belt is parallel to the guide rods.

In the center folding unit having the above-mentioned structure, although not particularly shown, the lower bundle conveying roller 206 approaches and is separated from the counter lower bundle conveying roller 206 and releases pressure when conveying a sheet bundle SB along the saddle-stitching tray G. Further, the additionally folding roller 520 performs additionally folding by moving in the direction substantially orthogonal to the sheet conveying direction. That is, while the state of FIG. 20 is changed to the state of FIG. 21, the separation of the lower bundle conveying rollers 206 is performed as shown in FIGS. 4 and 5. Accordingly, while the clamping of the sheet bundle SB in the nip between the bundle conveying rollers 206 is released, center-folding is performed by the folding plate. 215 and the first folding rollers 230.

As described above, the lower bundle conveying roller 206 and the additionally folding roller 520 are driven by the pressure-release motor 510 and a driving force is transmitted to the drive transmission gear 511 from the drive transmission belt 515. The transmitted driving force is transmitted to the pressure-release gear 512 and the additionally folding roller driving gear 519 from the relay gear 513, and a driving force is further transmitted to the additionally folding roller driving pulley 514 through the additionally folding roller moving belt 517, so that the additionally folding roller moving belt 516 is operated. Finally, the additionally folding roller 520 is driven by the additionally folding roller moving belt 516.

According to a positional relationship between the additionally folding roller 520 and the lower bundle conveying rollers 206, the pressure of the lower bundle conveying rollers 206 is released when the additionally folding roller 520 is positioned at the home position or the maximum displacement position. The reason for this is that a sheet is jammed if the additionally folding roller 520 is positioned in a conveying range of the sheet bundle SB when folding is performed by the first folding rollers 230.

If the sheet bundle SB reaches an additionally folding position when additionally folding is performed by the additionally folding unit 525 including the additionally folding roller 520, the sheet bundle SB is stopped and the additionally folding roller 520 scans the sheet bundle at a substantially right angle so as to correspond to the folded portion of the stopped sheet bundle. This state, is shown in FIGS. 24A to 24C. FIG. 24A shows a state immediately before the additionally folding mechanism runs on the folded portion to be additionally folded, FIG. 24B shows a state immediately after the additionally folding mechanism runs on the folded portion to be additionally folded and begins to perform additionally folding, and FIG. 24C shows a state when the additionally folding mechanism continues to perform additionally folding. The additionally folding is reciprocatingly performed at least one time in the width direction of the sheet bundle SB as shown in FIG. 25.

When the additionally folding is completely performed by the additionally folding roller 520, the sheet bundle SB is conveyed to the downstream side and is conveyed to the back portion forming device disposed on the rear side or other processing devices by the lower sheet ejecting rollers 231. If there is no processing device on the rear side, the sheet bundle is ejected to a sheet ejection tray (not shown) as it is.

Meanwhile, FIG. 22 shows an example where convey rollers 232 and second folding rollers 233 instead of the additionally folding roller 520 are provided on the downstream side of the first folding rollers 230. Since the convey rollers 232 and the second folding rollers 233 are shown in FIG. 22 in contrast with FIGS. 20 and 21, the additionally folding roller 520 is shown. However, the additionally folding unit 525 including the additionally folding roller 520 and a mechanism Q for driving the additionally folding unit 525 are omitted in an actual device.

In this example, after folding is performed by the first folding rollers 230, the second folding rollers 233 further perform additionally folding at the nip parallel to the folded portion like the first folding rollers 230.

Figure 26A:
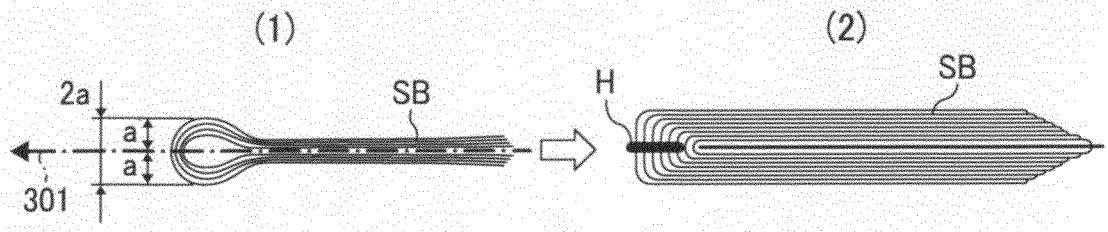
FIGS. 26A to 26C are views showing the state of the change of a sheet bundle that is output when a folded portion of the sheet bundle is swelled and a flat surface is formed at a back portion of the sheet bundle.
Figure 26B:
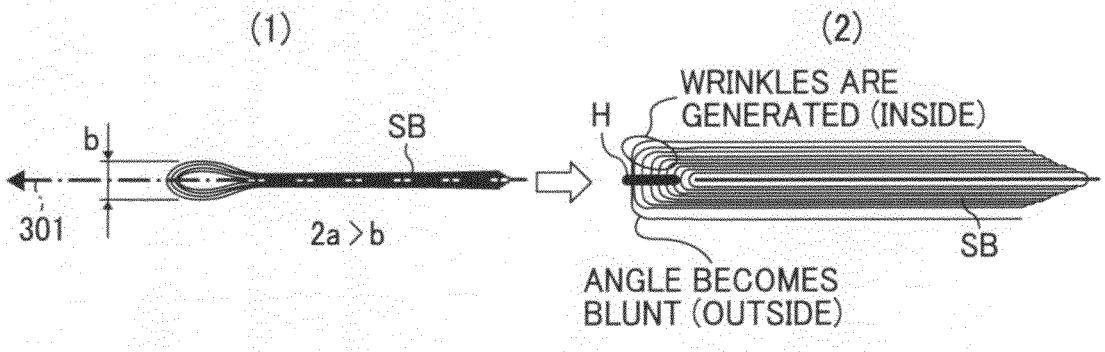
Figure 26C:
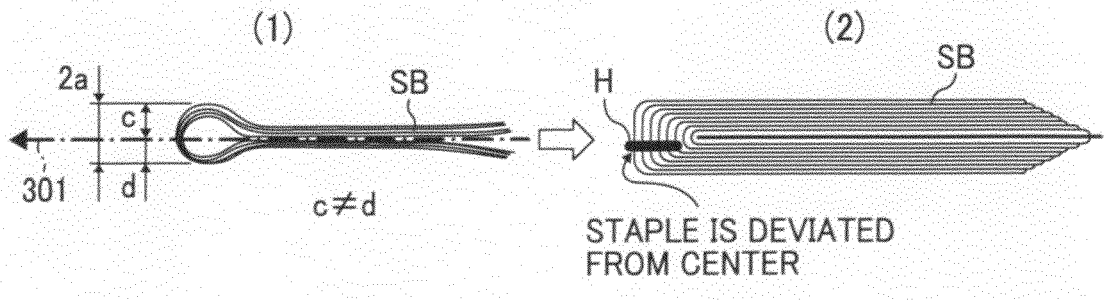

A case where swelling is generated at the back surface of the sheet bundle SB and the back surface is shaped, and a case where the folded portion of the sheet bundle SB is additionally folded by a force perpendicular to the sheet surface and the folded portion is made flat have been described above. However, in the former case, a problem occurs in the shaping of the back portion as shown in FIGS. 26A to 26C. FIGS. 26A to 26C are views showing the state of the change of a sheet bundle that is output when a folded portion of the sheet bundle SB is swelled and a flat surface is formed at a back portion of the sheet bundle.

When the back portion of the sheet bundle is formed in a flat shape in the steps shown in FIGS. 11 to 16, a surface is formed at the back portion of the sheet bundle SB by normally swelling the sheet bundle as shown in FIGS. 26A to 26C, so that it may be possible to form a booklet having an angular shape. In this case, the difference in the quality of the formed back portion is caused by the thickness 2*a* and swelling of the sheet bundle SB, or the difference in the stitching position of a staple and the dimension of the swelling in the thickness direction. FIG. 26A shows the formation state of a back portion when the amount of swelling is appropriate, FIG. 26B shows the formation state of a back portion when the amount of swelling is smaller than an appropriate value, and FIG. 26C shows the formation state of a back portion when the amount of swelling at the upper portion of the back portion is different from that at the lower portion of the back portion. In FIGS. 26A to 26C, the amount of swelling is appropriate when the amount of swelling on one side is "a". If swelling on one side of the conveyance center 301 of the two-folded sheet bundle SB is an appropriate amount "a" in FIG. 26A ((1) of FIG. 26A), the back portion is formed so as to be symmetric with respect to a staple H and corners of the back portion of each sheet are sharply formed.

On the other hand, if the amount "b" of swelling is smaller than an appropriate amount "2a" ($2a>b$) as shown in (1) of FIG. 26B, even though the back portion of a sheet bundle SB having the same thickness as the thickness of the sheet bundle shown in FIG. 26A is shaped as shown in (2) of FIG. 26B, a flat surface of the back portion is not formed as a sufficient surface and a surface forming area is moved to an angular-shaped portion, so that an angular-shaped portion becomes blunt. Alternatively, in addition to this, a marginal sheet surface moved to the angular-shaped portion causes wrinkles. Meanwhile, wrinkles are formed inside the corners. Further, if the swelling of the folded portion of the sheet bundle SB is restricted by additionally folding or the like, even though the amount of swelling of the entire sheet bundle SB is appropriate, that is, 2*a* as shown in (1) of FIG. 26C when the sheet bundle SB is actively swelled, the upper and lower portions of the sheet bundle SB are not equally swelled ($c \neq d$). For this reason, when a surface is to be formed at the back portion of a booklet, a flat surface is formed at a position where the position of the staple H is deviated from the middle portion (the conveyance center 301 in FIG. 26C). Among these cases, the two latter cases are examples of an inappropriate case. From these cases, it is understood that a sheet bundle SB needs to be maintained in an easily-swelled shape in the processing for forming a flat surface at the back portion of a sheet bundle SB. That is, the reason for this is that making a sheet bundle SB have an easily-swelled shape is preferable to form a surface at the back portion of a sheet bundle SB and to form corners at a sheet bundle SB well in the processing for forming a surface at the back portion of a sheet bundle SB as shown in FIGS. 26A to 26C.

However, when a flat surface is not formed at the back portion of a sheet bundle SB, the pressurizing forces of the necessary first and second folding rollers 230 and 233 and the additionally folding performed by the additionally folding roller 520 become means effective to reduce the folding height of a center-folded booklet. That is, if a folded portion of the sheet bundle SB is formed by the first and second folding rollers 230 and 233 or the additionally folding roller 520 or the swelling of a folded portion is reduced by additionally folding, it may be possible to handle a large number of sheet bundles SB while stacking the sheet bundles.

Accordingly, in this embodiment, center folding may be selected according to whether to form a flat surface at the back portion of a sheet bundle SB, the thickness of a sheet, the thickness of a sheet bundle, and the number of stitched sheets; optimum center folding may be performed on each sheet bundle to be folded; and the sheet bundle is output.

Specifically, the following processing is performed.

1) When a flat surface is not formed at the back portion of a sheet bundle SB, the pressurizing force of the folding rollers is adjusted or the additionally folding performed by the additionally folding roller is performed.

2) When a flat surface is formed at the back portion of a sheet bundle SB, additionally folding is cancelled.

3) When a flat surface is formed at the back portion of a sheet bundle SB, the pressurizing force of the folding rollers is reduced so that a folded portion of the sheet bundle is easily swelled when a flat surface is to be formed at the back portion of a sheet bundle SB. Then, the sheet bundle is conveyed to a processing device that forms a flat surface on a back surface of the sheet bundle and is provided on the rear side.

Figure 27:
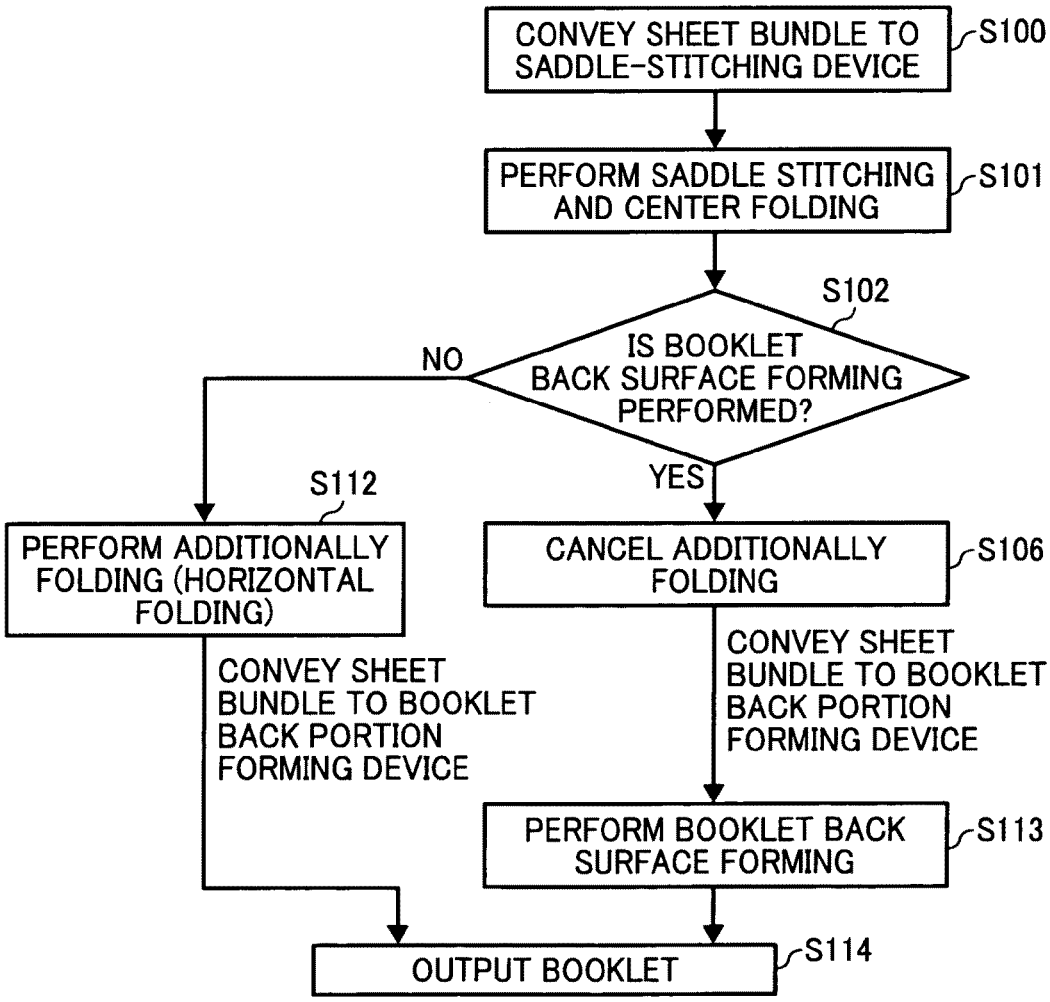
FIG. 27 is a flowchart illustrating a control procedure for changing the content of the additionally folding according to whether to perform back surface forming.
Figure 28:
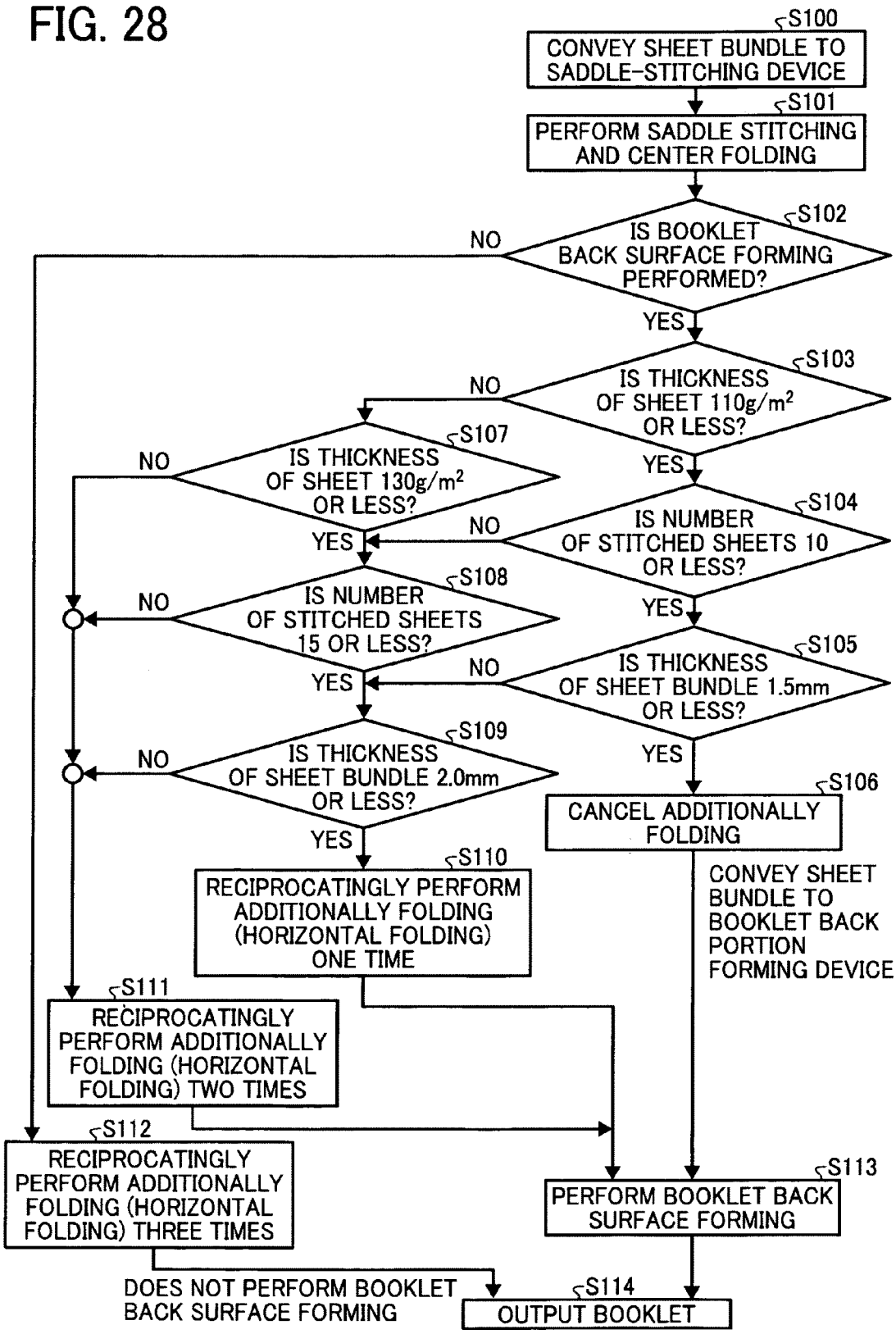
FIG. 28 is a flowchart illustrating a procedure for setting the optimum ease of swelling of a sheet bundle by the number of times of additionally folding (horizontal folding)

FIG. 27 is a flowchart illustrating a control procedure for changing the content of additionally folding according to whether to perform back surface forming, and FIG. 28 is a flowchart illustrating a procedure for setting the optimum ease of swelling of a sheet bundle SB by the number of times of additionally folding (horizontal folding). The above-mentioned processing is performed, by the CPU 3-1 of the back portion forming device 3 under the control of the CPU 100-1 of the MFP 100 through the communication with the CPU 100-1 of the MFP 100.

In FIG. 27, a saddle-stitching instruction and a center-folding instruction are received, saddle-stitching is performed on a sheet bundle SB (Step S100), which is conveyed to the saddle-stitching device 2, in the saddle-stitching device 2 (Step S101). Then, it is determined whether to perform the processing (referred to as booklet back surface forming in the flowchart) for forming a flat surface at a back surface of the sheet bundle SB (the sheet bundle SB is referred to as a booklet in the flowchart) (Step S102). This determination is to determine whether to perform the back surface forming. If the back surface forming is not set (NO in Step S102), normal additionally folding is performed on the sheet bundle in the saddle-stitching device 2 (Step S112) and the sheet bundle is conveyed to the back portion forming device 3 and output as a booklet from the back portion forming device 3 (Step S114).

If the back surface forming is set (YES in Step S102), additionally folding is cancelled (Step S103), the sheet bundle is conveyed to the back portion forming device 3, back portion forming is performed on the sheet bundle in the back portion forming device 3 (Step S113), and the sheet bundle is output as a booklet.

Further, if the optimum ease of swelling of a sheet bundle SB is to be set by the number of times of additionally folding (horizontal folding), in FIG. 28, a saddle-stitching instruction and a center-folding instruction are received, saddle-stitching is performed on the sheet bundle SB, which is conveyed to the saddle-stitching device 2, in the saddle-stitching device 2 (Step S101). Then, it is determined whether to perform the booklet back surface forming for forming a flat surface at a back surface of the sheet bundle SB (Step S102). If the back surface forming is not set (NO in Step S102), normal additionally folding is performed on the sheet bundle in the saddle-stitching device 2 (Step S112) and the sheet bundle is conveyed to the back portion forming device 3 (Step S112). Here, since the back surface forming of the sheet bundle SB (booklet) is not performed, the sheet bundle SB is output without being subjected to the back surface processing (Step S114).

If the back surface forming is set in Step S102 (YES in Step S102), additionally folding is cancelled (Step S103), the regulations of the kind of a sheet (the thickness of a sheet), the number of stitched sheets, and the thickness of the sheet bundle are determined by Steps S103 to S105 that are first criteria. If the regulations are satisfied in this determination, additionally folding (horizontal folding) is cancelled (Step S106). Here, criteria (the first criteria and second criteria to be described below) are set on the basis of the ease of swelling of a saddle-stitched sheet bundle, and the numerical values of the criteria may be changed according to the characteristics (stripe direction and the like) of a sheet to be used. Further, after being determined by the first criteria (Steps S103 to S105), the regulations of the kind of a sheet, the number of stitched sheets, and the thickness of the sheet bundle are determined again by second criteria (Steps S107 to S109) and additionally folding is performed by the number of times of additionally folding that is smaller than that of normal setting (Step S110). Furthermore, if the rigidity of a sheet bundle SB is high and a sheet bundle SB is apt to be loosened by the conditions of the kind of a sheet, the number of stitched sheets, and the thickness of the sheet bundle, additionally folding is performed by the number of times of additionally folding that is normally set (Step S111).

In this embodiment, according to the first criteria, the thickness of a sheet is 110 g/m$^2$ or less in Step S103, the number of stitched sheets is 10 or less in Step S104, and the thickness of a sheet bundle is 1.5 mm or less in Step S105. According to the second criteria, the thickness of a sheet is 130 g/m$^2$ or less in Step S107, the number of stitched sheets is 15 or less in Step S108, and the thickness of a sheet bundle is 2.0 mm or less in Step S109.

Moreover, the number of times of additionally folding, which corresponds to normal setting, is 2 (Step S111), and the number of times of additionally folding, which is smaller than normal setting, is 1 (Step S110).

When the thickness of a sheet is larger than 110 g/m$^2$ in Step S103 since the criteria are set as described above, it is determined whether the thickness of a sheet is equal to or smaller than 130 g/m$^2$ in Step S107. When the thickness of a sheet is larger than 130 g/m$^2$, additionally folding is performed two times in Step S111. When the thickness of a sheet is equal to or smaller than 130 g/m$^2$, the process proceeds to Step S101. Even when the thickness of a sheet is 110 g/m$^2$ or less in Step S103 and the number of stitched sheets is larger than 10 (NO in Step S104), the determination of Step S108 is performed. When the number of stitched sheets is larger 15, additionally folding is performed two times in Step S111. When the number of stitched sheets is equal to or smaller than 15, the process proceeds to Step S109. When the number of stitched sheets is 10 or less in Step S104, and the thickness of a sheet bundle is smaller than 1.5 mm, the determination of Step S109 is performed. When the thickness of a sheet bundle is larger 2.0 mm, additionally folding is performed two times in Step S111. Only when the thickness of a sheet bundle is equal to or smaller than 2.0 mm, additionally folding is performed one time in Step S110.

The sheet bundle SB, which has been subjected to predetermined processing in Steps S103 to S111, is conveyed to the back portion forming device 3, is subjected to back surface forming for forming a flat surface at a back portion of the sheet bundle SB (Step S113), and a sheet bundle (booklet) SB that has a flat surface formed at the back portion thereof is output (Step S114).

Meanwhile, criteria and two processing modes performed by determination have been shown in the flowchart shown in FIG. 28. Criteria and processing modes performed by determination may be added according to need. Further, as described above, the numerical values of the kind of a sheet, the number of stitched sheets, and the thickness of the sheet bundle, which have been used in the determination as described above, may be appropriately set according to the characteristics of the sheet.

Furthermore, additionally folding may be performed using the second folding rollers 233 instead of the additionally folding that is performed by the additionally folding roller 520 as shown in FIG. 22. In this case, additionally folding is performed in Steps S112 and S111 by the second folding rollers 233 and folding is performed by only the first folding rollers 230 in Step S110.

Figure 29:
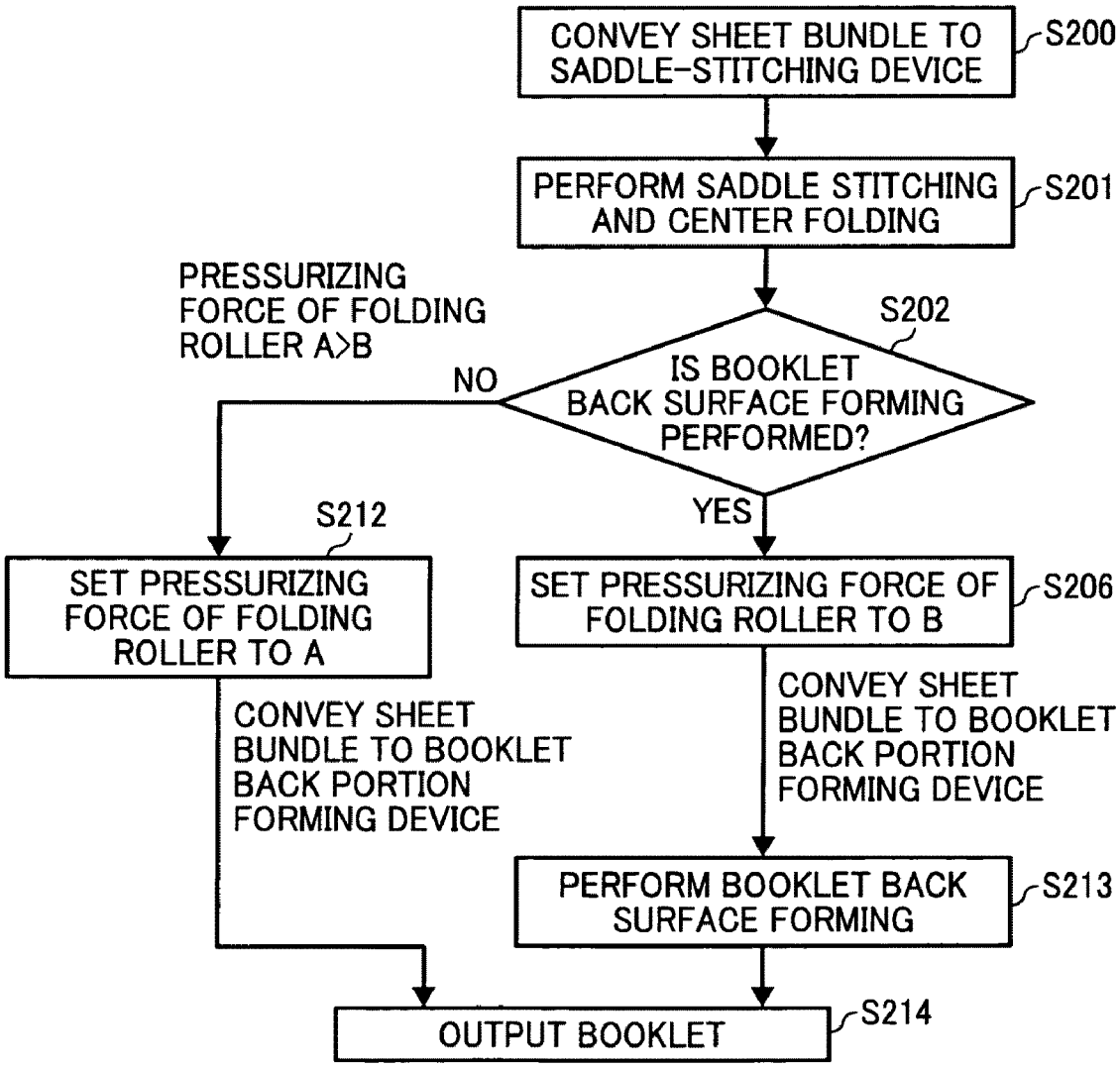
FIG. 29 is a flowchart illustrating control means for changing the content of center folding according to whether to perform back surface forming.
Figure 30:
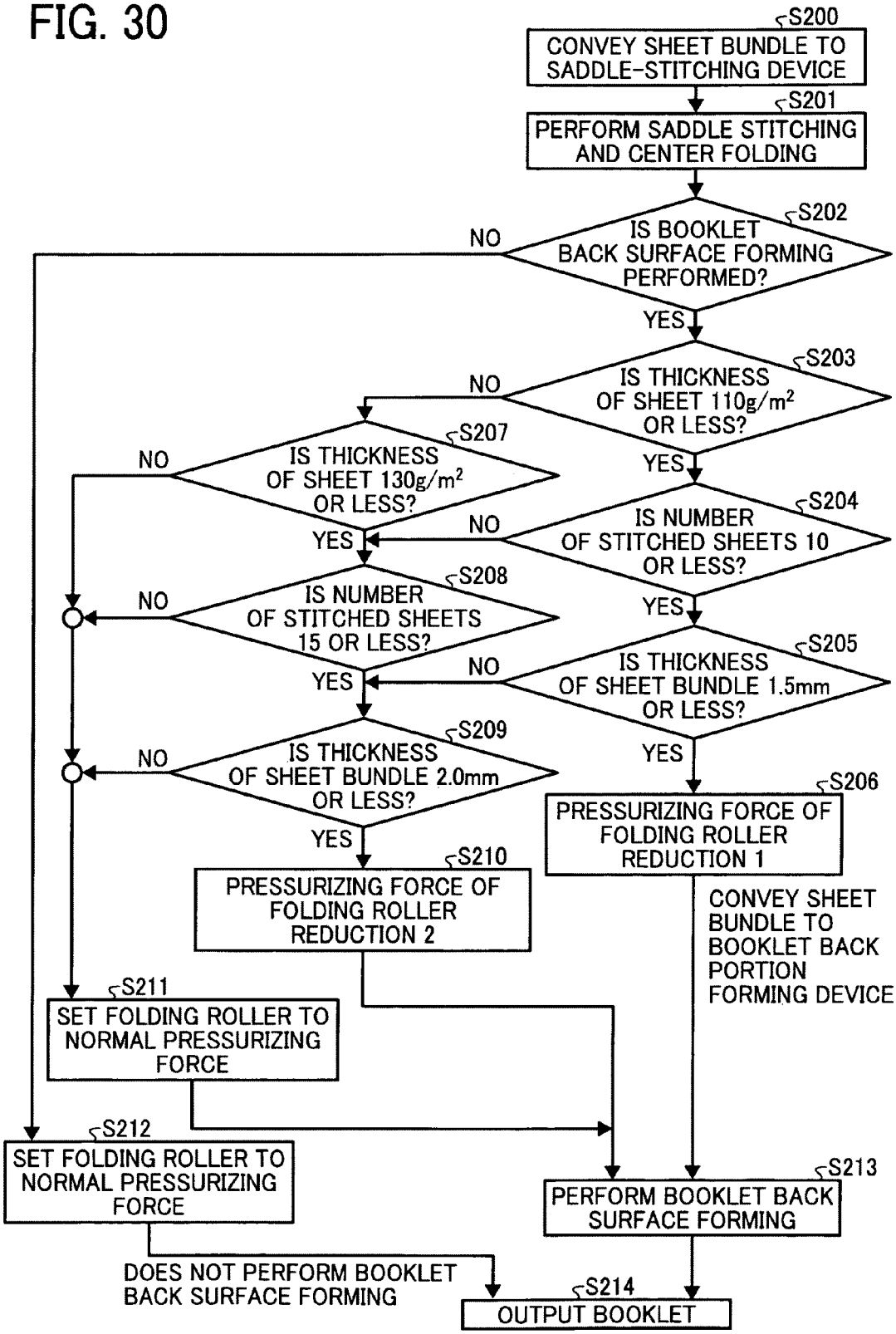
FIG. 30 is a flowchart illustrating a procedure for setting the optimum ease of swelling of a sheet bundle by the adjustment of a pressurizing force of the folding roller.

FIG. 29 is a flowchart illustrating control means for changing the content of center folding according to whether to perform back surface forming; and FIG. 30 is a flowchart illustrating a procedure for setting the optimum ease of swelling of a sheet bundle SB by the adjustment of a pressurizing force of the folding roller.

In FIG. 29, a saddle-stitching instruction and a center-folding instruction are received, saddle-stitching is performed on a sheet bundle SB (Step S200), which is conveyed to the saddle-stitching device 2, in the saddle-stitching device 2 (Step S201). Then, it is determined whether to perform booklet back surface forming at a back surface of the sheet bundle SB (Step S202). If the back surface forming is not set in this determination (NO in Step S202), a pressurizing force of the folding rollers 230 is set to predetermined A, the sheet bundle SB is center-folded (Step S212), is conveyed to the back portion forming device 3, and is output as a booklet without being subjected to the booklet back surface processing in the back portion forming device 3 (Step S214).

If the back surface forming is set (YES in Step S202), the pressurizing force of the folding rollers 230 is set to B smaller than A and the sheet bundle is center-folded (Step S206), the sheet bundle is conveyed to the back portion forming device 3, back portion forming is performed on the sheet bundle in the back portion forming device 3 (Step S213), and the sheet bundle is output as a booklet (Step S214). Meanwhile, the pressurizing forces A and B may be set to, for example, high and low pressurizing forces that are shown in FIGS. 19(*a*) and 19(*b*).

When the optimum ease of swelling of a sheet bundle is set by the adjustment of a pressurizing force of the folding roller, processing of Steps S200 to S214 are performed as shown in FIG. 30. In this case, since the other steps except for Step S206 and Steps S210 to S212 are the same as the other steps except for Step S106 and Steps S110 to S112 of the flowchart shown in FIG. 28, the repeated description will be omitted.

Meanwhile, in Steps S211 and S212, the pressurizing force of the folding rollers 230 is the high pressurizing force shown in FIG. 19(*a*). In Step S206, the pressurizing force of the folding rollers is the minimum pressurizing force shown in FIG. 19(*b*), that is, a pressurizing force when the compression spring is slightly pressurized (pressurizing force reduction 1).

In Step S210, the rotation angle of the eccentric cam 603 is between the rotation angles shown in FIGS. 19(*a*) and 19(*b*), and the compression spring is pressurized by a pressurizing force (pressurizing force reduction 2) corresponding to the middle (middle value) between FIGS. 19(*a*) and 19(*b*). In Step S113, the sheet bundle is conveyed to the back portion forming device 3.

A sheet bundle (booklet) SB, where a flat surface is formed at a back portion or a back portion is made flat by additionally folding, is ejected as it is. Alternatively, ends may be cut by an edge cutting device 4 for the removal f irregularities of ends that are caused by back portion forming.

Figure 33:
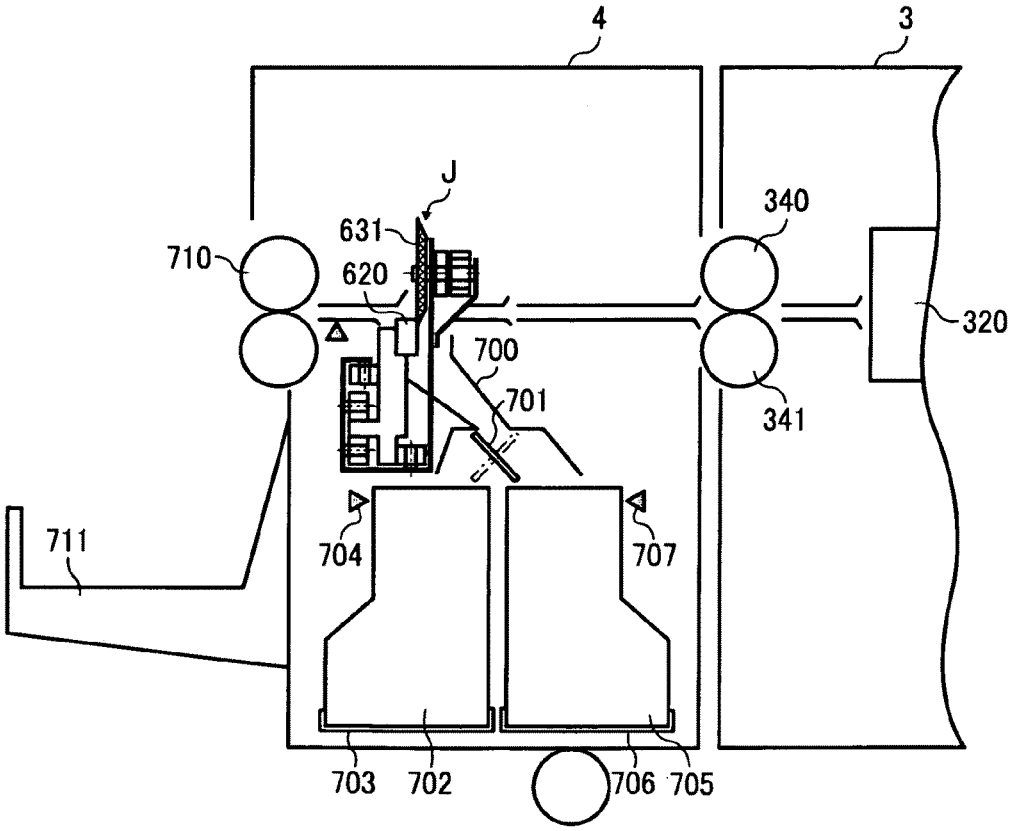
FIG. 33 is an enlarged schematic view showing the cutter unit and a portion near an installation position of the cutter unit.

As shown in FIG. 33, the edge cutting device 4 is connected to the rear portion of the back portion forming device 3. A sheet feed path of the edge cutting device 4 is connected to a sheet ejection path of the back portion forming device 3, and a sheet bundle SB is carried in the edge cutting device 4 by the upper and lower sheet ejecting rollers 340 and 341 that are provided at the most downstream portion of the sheet ejection path of the back portion forming device 3.

Figure 31:
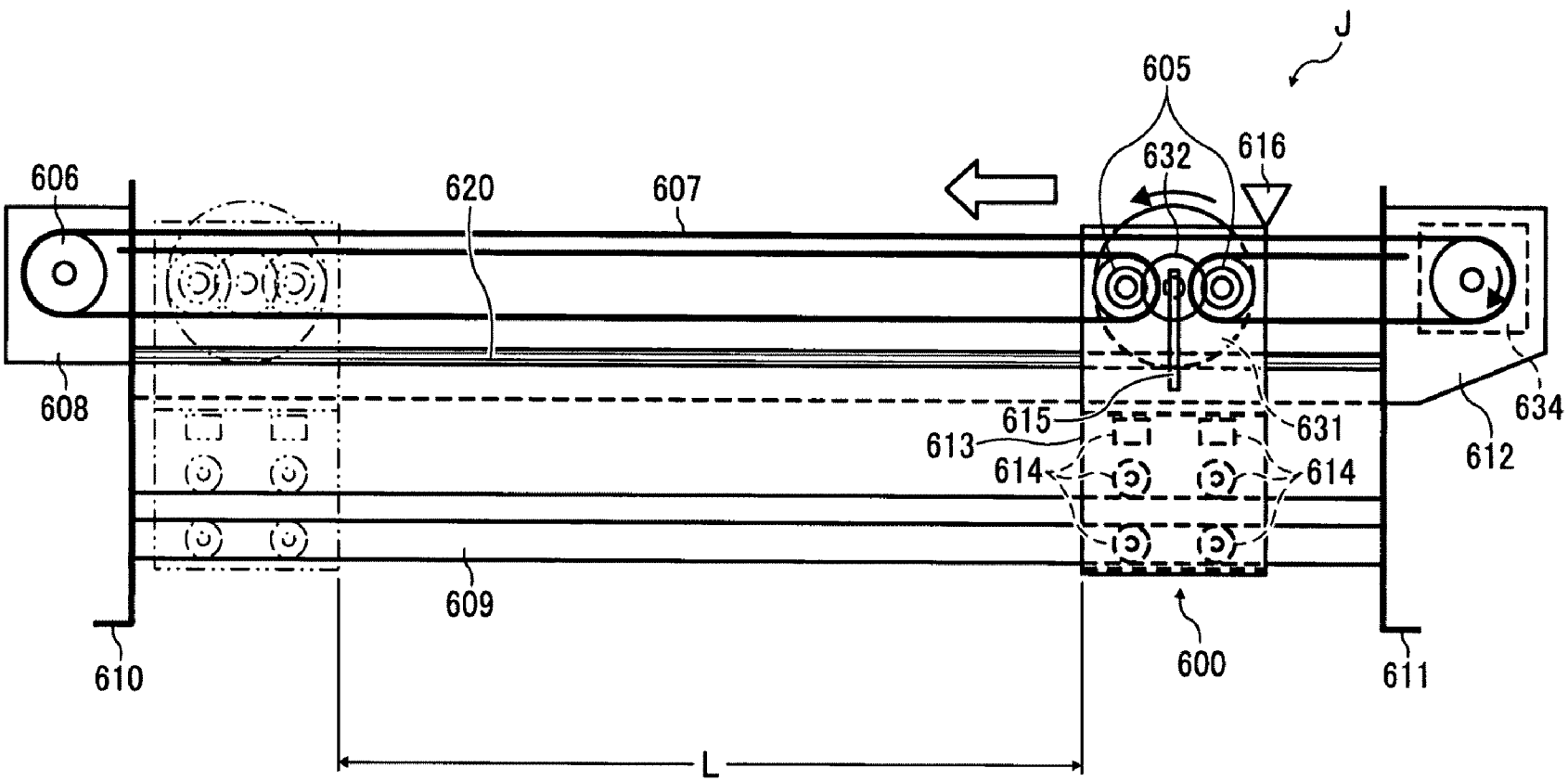
FIG. 31 is a view showing a cutter unit, a slide unit, and driving mechanisms thereof.
Figure 32:
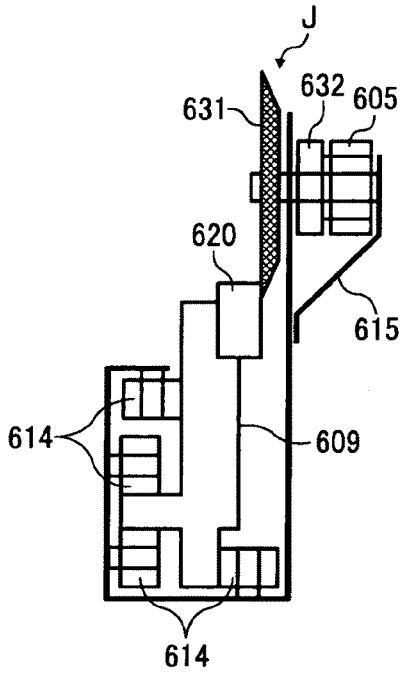
FIG. 32 is a right side view of the cutter unit shown in FIG. 31.

FIG. 31 is a front view showing a cutter unit, a slide unit, and driving mechanisms thereof, and FIG. 32 is a right side view of the cutter unit shown in FIG. 31. In FIGS. 31 and 32, a stationary blade 620 is fixed to a stay 609 and the stay 609 is fixed to side plates 610 and 611, so that the cutter unit has the structure formed as an independent unit. A bracket 608 and a motor bracket 612 are fixed to the side plates 610 and 611, respectively, and an idler pulley 606 and a cutter motor 634 are fixed to the bracket and the motor bracket, respectively. Meanwhile, a slider base 613 is disposed so that rollers 614 rotatably clamp the stay 609, and the slider base 613 can move linearly. The slider base 613 is provided with two-stage idler gears 605 that have the tooth profile of a belt and the tooth profile of a gear. Further, a round blade 631 is connected to a drive gear 632 so that the slider base 613 is interposed between a shaft and the round blade 631. Accordingly, when the idler gears 605 are rotated, the round blade 631 is also rotated.

Since being pressed from the drive gear 632 by a leaf spring 615, the round blade 631 is abutted on the stationary blade 620 while having always an appropriately pressing force. A timing belt 607 is an ending belt, both ends of the timing belt are fixed as shown in FIG. 29, and the cutter motor 634 is also stretched on a pulley, an idler pulley 606, and two idler gears 605. Accordingly, when the rotating shaft of the cutter motor 634 is rotated in a clockwise direction in FIG. 29, a slide unit 600 is moved to the left side in FIG. 31 while the round blade 631 is rotated in a counterclockwise direction. In this case, if a sheet exists in a gap between the round blade 631 and the stationary blade 620, cutting is performed.

Further, the home position of the slide unit 600 is detected by a cutter HP sensor 616. Meanwhile, two hoppers 702 and 705 for collecting swarf are provided below a cutter unit J.

FIG. 33 is an enlarged schematic view showing the cutter unit J and a portion near an installation position of the cutter unit. In FIG. 33, a guide 700, which guides swarf cut by the cutter unit J to the hoppers 702 and 705, is provided above the hoppers 702 and 705. The guide 700 includes an opening that is used to receive swarf and is provided near the cutter, and an opening that is provided above the hopper.

Each of the hoppers 702 and 705 is formed in the shape of a box to receive swarf, and has a width that is equal to or larger than the maximum sheet size in a direction perpendicular to the plane of FIG. 33. When being full of sheets, the hoppers 702 and 705 are adapted to be pulled to the front side from holders 703 and 706 in a direction perpendicular to the plane of FIG. 33. Moreover, a switching claw 701 is provided at the outlet of the guide 700 so as to distribute swarf to the respective hoppers 702 and 705. The switching claw is reciprocatingly rotated between a position shown by a solid line and a position shown by a two-dot chain line, so that this distribution is performed. Reference numerals 704 and 707 denote full sensors for detecting whether the hoppers are full of swarf. Meanwhile, a booklet (sheet bundle) SB of which the end has been cut by the round blade 631 is ejected onto a sheet ejection tray 711 from sheet ejecting rollers 710.

As described above, when a flat surface is to be formed at the back portion of a sheet bundle SB by the back portion forming device 3, a pressurizing force of the folding rollers has been increased for the purpose of the reduction of the swelling of a booklet or an additionally folding roller has been disposed on the downstream side of the folding rollers and pressurized the two-folded portion so as to reduce the swelling of a booklet in the thickness direction of the booklet in a saddle-stitching and center-folding of a booklet in the conventional technology. However, if the swelling of a booklet in the thickness direction of the booklet is reduced in the forming a surface at the back portion of the booklet, it is difficult to swelling the back portion of the booklet when a flat surface is formed at the back portion of the booklet. Accordingly, in this embodiment, it may be possible to reduce the swelling of a booklet in the thickness direction of the booklet by the number of times of additionally folding of the additionally folding roller 520, the addition of additionally folding performed by the second folding rollers 233, the adjustment of the pressurizing force of the first folding rollers 230, or the like, according to a case where a flat surface is to, be formed at the back portion of a booklet or a case where a flat surface is not to be formed at the back portion of a booklet. As a result, according to this embodiment, it may be possible to obtain the following advantages.

1) Since processing is performed so as to quickly form a surface at the back portion of a back portion as compared to the conventional technology without generating wrinkles, breakage, or the like on a back surface or a stitched portion, it may be possible to reduce the swelling of a booklet in the thickness direction of the booklet.

2) Since optimum folding is performed on each of the booklets that are subjected to the forming a flat surface at the back portion of a booklet, saddle-stitching, and center-folding, it may be possible to provide a booklet of which swelling in the thickness direction is reduced under the best conditions.

3) Since swelling can be reduced by only the change of control, a mechanism does not be complicated. Accordingly, it may be possible to expect the reduction of the size of a device, the reduction of the manufacturing cost, and the reduction of power consumption and to provide an environment-friendly device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

According to the invention, it may be possible to reduce the folding height of a booklet in accordance with user's preference, regardless of whether back surface forming is performed on a booklet. That is, since additionally folding is prohibited or the number of times of additionally folding is reduced when back surface forming is performed on a booklet, it may be possible to secure the quality of back surface forming of a booklet, to reduce the power consumption, and to secure productivity. Meanwhile, since additionally folding is performed when back surface forming is not performed on a booklet, it may be possible to reduce the folding height of a booklet.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A bookbinding system comprising:

a center folding unit configured to perform center folding on an integrated sheet bundle;

an additionally folding unit configured to additionally perform folding of a folded portion of the center-folded sheet bundle;

a back surface forming unit configured to form a back surface on the sheet bundle by pressing a front end of the folded portion of the center-folded sheet bundle and both surfaces of the sheet bundle; and a control unit configured to change a process of additionally folding according to whether to perform the back surface forming or not.

2. The bookbinding system according to claim 1, wherein the control unit is configured to change a process of center folding or additionally folding on the basis of predetermined conditions of a sheet and a sheet bundle in addition to whether to perform the back surface forming or not.

3. The bookbinding system according to claim 2, wherein the control unit does not perform additionally folding when performing the back surface forming.

4. The bookbinding system according to claim 3, wherein the predetermined conditions are set on the basis of the kind of a sheet including the thickness of the sheet.

5. The bookbinding system according to claim 3, wherein the predetermined conditions are set on the basis of the number of sheet bundles.

6. The bookbinding system according to claim 3, wherein the predetermined conditions are set on the basis of the thickness of a center-folded sheet bundle.

7. The bookbinding system according to claim 2, wherein the center folding unit includes a variable pressurizing force unit configured to change a pressurizing force applied to a sheet bundle, and the control unit is configured to change the pressurizing force of the variable pressurizing force unit according to whether to perform the back surface forming or not.

8. The bookbinding system according to claim 2, wherein the control unit is configured to change the number of times of the additionally folding according to whether to perform the back surface forming or not-.

9. The bookbinding system according to claim 8, wherein the predetermined conditions are set on the basis of the kind of a sheet including the thickness of the sheet.

10. The bookbinding system according to claim 8, wherein the predetermined conditions are set on the basis of the number of sheet bundles.

11. The bookbinding system according to claim 8, wherein the predetermined conditions are set on the basis of the thickness of a center-folded sheet bundle.

12. The bookbinding system according to claim 2, wherein the predetermined conditions are set on the basis of the kind of a sheet including the thickness of the sheet.

13. The bookbinding system according to claim 2, wherein the predetermined conditions are set on the basis of the number of sheet bundles.

14. The bookbinding system according to claim 2, wherein the predetermined conditions are set on the basis of the thickness of a center-folded sheet bundle.

15. The bookbinding system according to claim 1, wherein the back surface forming unit includes a conveying unit configured to convey the sheet bundle, an abutting unit configured to be being abutted on the folded portion of the sheet bundle, a first and second clamping unit configured to clamp the sheet bundle in a thickness direction, and a discharging unit configured to discharge the sheet bundle to a sheet ejection tray, wherein the conveying unit, the first clamping unit, the second clamping unit, the abutting unit, and the discharging unit are disposed in the above-described order from the upstream side to the downstream side in a sheet conveying direction, and the control unit is configured to form swelling of the sheet bundle between the abutting unit and the conveying unit by further conveying the sheet bundle, which is conveyed by the conveying unit, from a position where a front end of the folded portion of the sheet bundle is abutted on the abutting unit, by a predetermined distance and then to stop the sheet bundle; and shapes the back surface of the sheet bundle by pressing a part of the swelling by a first pressing-clamping unit and pressing swelling of the sheet bundle, which is formed between the abutting unit and the first pressing-clamping unit, by a second pressing-clamping unit.

16. The bookbinding system according to claim 1, further comprising:

a saddle-stitching unit configured to stitch a portion of the sheet bundle near the folded portion of the sheet bundle.

17. The bookbinding system according to claim 1, wherein an image forming apparatus is disposed on the front side of the bookbinding system.

18. A bookbinding method for bookbinding a sheet bundle, the bookbinding method comprising:

performing center folding of an integrated sheet bundle;

performing additionally folding of a folded portion of the center-folded sheet bundle; and performing back surface forming on the sheet bundle by pressing a front end of the folded portion of the center-folded sheet bundle and both surfaces of the sheet bundle, wherein a process of additionally folding is changed according to whether to perform the back surface forming or not.

* * * * *